US008881947B2

(12) United States Patent
Yildirim

(10) Patent No.: US 8,881,947 B2
(45) Date of Patent: Nov. 11, 2014

(54) DISPENSING CONTAINER

(76) Inventor: Müslüm Yildirim, The Hague (NL)

( * ) Notice: Subject to any disclaimer, the term of this patent is extended or adjusted under 35 U.S.C. 154(b) by 0 days.

(21) Appl. No.: 13/805,282

(22) PCT Filed: Jun. 23, 2011

(86) PCT No.: PCT/NL2011/050456

§ 371 (c)(1),
(2), (4) Date: Jan. 7, 2013

(87) PCT Pub. No.: WO2011/162609

PCT Pub. Date: Dec. 29, 2011

(65) Prior Publication Data

US 2013/0105514 A1 May 2, 2013

(30) Foreign Application Priority Data

Jun. 23, 2010 (NL) ..... 2004947
May 19, 2011 (NL) ..... 2006817

(51) Int. Cl.

| | |
|---|---|
| ***B65D 35/28*** | (2006.01) |
| ***B65D 35/54*** | (2006.01) |
| ***B67B 1/00*** | (2006.01) |
| ***B65D 83/00*** | (2006.01) |
| ***B65D 47/24*** | (2006.01) |

(52) U.S. Cl.

CPC ..... *B65D 35/28* (2013.01); *B65D 83/0066* (2013.01); *B65D 47/242* (2013.01)

USPC ..... 222/104; 222/96; 222/142.9; 222/153.14

(58) Field of Classification Search

USPC ..... 222/104, 99, 142.9, 153.14, 9, 153.146; 220/6, 8, 260, 262, 281, 345.1, 345.2; 29/428; 206/3, 585, 592, 593; 401/172, 401/65, 66, 74

See application file for complete search history.

(56) References Cited

U.S. PATENT DOCUMENTS

| | | | | | |
|---|---|---|---|---|---|
| 1,870,903 | A | * | 8/1932 | Giesler | 222/92 |
| 2,203,313 | A | * | 6/1940 | Thorn | 222/104 |
| 2,234,857 | A | * | 3/1941 | Thorn et al. | 222/104 |
| 2,333,320 | A | * | 11/1943 | Lautmann | 222/104 |
| 2,721,676 | A | * | 10/1955 | Andrews | 222/104 |
| 4,060,179 | A | * | 11/1977 | McGhie | 222/92 |
| 5,025,960 | A | * | 6/1991 | Seager | 222/390 |
| 6,116,448 | A | * | 9/2000 | Fragos | 220/8 |

(Continued)

FOREIGN PATENT DOCUMENTS

| | | | |
|---|---|---|---|
| EP | 1306314 | A1 | 5/2003 |
| FR | 975890 | A | 3/1951 |
| FR | 1161905 | A | 9/1958 |

*Primary Examiner* — Paul R Durand
*Assistant Examiner* — Benjamin R Shaw
(74) *Attorney, Agent, or Firm* — Bret E. Field; Bozicevic, Field & Francis, LLP

(57) ABSTRACT

The present invention relates to a dispensing container, comprising:—an elongate frame with a first end and a second and; and—an elongate reservoir extending between the first end and the second end of the frame; wherein the reservoir comprises: —a foldable wall which is connected at a first end thereof to the frame close to the first end of the frame for rotation around a longitudinal axis of the frame by means of an operating element, and which is connected non-rotatably to the frame at a second end thereof; and—a dispensing opening close to the first end of the frame.

20 Claims, 17 Drawing Sheets

(56) References Cited

U.S. PATENT DOCUMENTS

| | | | | |
|---|---|---|---|---|
| 7,178,692 | B2 * | 2/2007 | Ophardt | 222/104 |
| 2005/0029292 | A1 * | 2/2005 | Ophardt | 222/94 |
| 2005/0274746 | A1 * | 12/2005 | Rego et al. | 222/390 |
| 2008/0121656 | A1 * | 5/2008 | deVirag et al. | 222/135 |
| 2008/0121665 | A1 * | 5/2008 | Wise et al. | 222/333 |
| 2008/0187390 | A1 * | 8/2008 | Rego et al. | 401/175 |

* cited by examiner

DISPENSING CONTAINER

The present invention relates to a dispensing container and to a method for manufacture thereof.

Many tubes are used in the packaging industry. The problem with the present tubes is that the final remaining content often cannot be removed or is very difficult to remove. Convenience of use hereby decreases at the final stage of use.

In addition, existing tubes have drawbacks such as the content 'plopping' out of the tube at the end, the often crumpled appearance and the tube per se having to stand on its head.

The present invention has for its object, among others, to reduce a number of the drawbacks of existing tubes.

The present invention provides for this purpose a dispensing container, comprising:

an elongate frame with a first end and a second and; and an elongate reservoir extending between the first end and the second end of the frame;

wherein the reservoir comprises:

a foldable wall which is connected at a first end thereof to the frame close to the first end of the frame for rotation around a longitudinal axis of the frame by means of an operating element, and which is connected non-rotatably to the frame at a second end thereof; and a dispensing opening close to the first end of the frame.

With the dispensing container according to the invention an accurate and constant dispensing of liquid materials from the reservoir is possible by means of a simple rotation of the operating element, wherein the foldable wall is twisted at the end remote from the dispensing opening so that substantially the whole content of the reservoir can be forced therefrom in controlled manner. Because the operating element is positioned close to the dispensing opening, the dispensing container can moreover be held comfortably in one hand and operated with this same hand.

In a favourable embodiment of the dispensing container according to the invention the reservoir comprises a constriction close to the second end of the foldable wall. This measure makes it possible to enhance twisting of the second end of the foldable wall during first use.

In a further favourable embodiment of the dispensing container according to the invention the reservoir comprises close to the first end of the foldable wall a displacing body with a number of displacement surfaces running obliquely from the first end of the foldable wall in the direction of the second end of the foldable wall, which displacement surfaces form at the end remote from the foldable wall an opening of a dispensing channel to the dispensing opening. These measures make it possible to compensate for space close to the dispensing opening which cannot be twisted. The number of displacement surfaces can be one, so that there is a continuous displacement surface. Alternatively, there is more than one displacement surface, wherein indentations running obliquely from the first end of the foldable wall in the direction of the second end of the foldable wall are preferably arranged between the displacement surfaces. These indentations make it possible, when the reservoir is almost empty, for the dispensing channel to be squeezed together from the opening, which is formed by the displacement surfaces, in the direction of the dispensing opening when the foldable wall is pushed against the displacement surfaces, so that liquid material present in the dispensing channel is forced in the direction of the dispensing opening. This has the advantage that less liquid material remains behind in the dispensing channel.

In a further favourable embodiment of the dispensing container according to the invention the second end of the foldable wall is connected to the frame by means of a guide element displaceable along the frame in the direction of the first end of the foldable wall. This measure makes it possible to compensate for the shortening of the foldable wall resulting from twisting thereof during the dispensing. The guide element also makes it possible here to provide resistance so that the constriction can be kept tight and fine during twisting of the foldable wall.

In an alternative embodiment hereof the frame can be reduced in length between the first end of the foldable wall and the second end of the foldable wall, wherein the frame between the first end of the foldable wall and the second end of the foldable wall is preferably at least one from the group of foldable together and slidable together.

In a further favourable embodiment of the dispensing container according to the invention the frame comprises a number of walls, these walls enclosing the reservoir in the longitudinal direction thereof. This measure enables a strong frame as well as protection and concealment of the reservoir. This measure also gives the designer of the dispensing container more freedom in respect of the shaping of the dispensing container, since it is possible to far-reaching extent to determine the form of the walls of the frame separately of the form of the reservoir. In addition, the walls provide a surface for printing.

In a further favourable embodiment hereof the cross-sectional periphery of the walls of the frame is one from the group of round, oval and polygonal. A suitable choice of the cross-sectional form of the periphery of the walls of the frame enables a comfortable positioning of the dispensing container in the hand of the user.

In a further favourable embodiment hereof the cross-sectional periphery of the walls of the frame is square. This measure makes it possible for the user, as a result of the angles, to have a good grip on the dispensing container during rotation of the operating element and, owing to the symmetry, also results in it making no difference how the user grasps the dispensing container.

In a further favourable embodiment of the dispensing container according to the invention, wherein the frame comprises a number of walls enclosing the reservoir in the longitudinal direction thereof:

the operating element has a circular outer periphery;

the inner periphery of the walls of the frame has a cross-sectional form varying from a circle; and a number of holes are arranged in the walls of the frame close to the first end of the frame;

wherein the dimensions of the inner periphery of the walls of the frame, of the outer periphery of the operating element and of the holes in the walls are such that a part of the operating element can be positioned in the space enclosed by the walls such that the centre of the operating element is positioned in the space enclosed by the walls and the outer periphery of the operating element at the position of the holes protrudes from the holes. These measures enable a particularly simple attachment of the reservoir on the frame. Alternatively, the operating element does not protrude into holes but is for instance arranged on the edge of the frame at the first end thereof by means of a connecting element.

In a further favourable embodiment of the dispensing container according to the invention:

the operating element is annular and the operating element has an inner periphery; and the reservoir also comprises a clamping body with an outer periphery;

wherein the inner periphery of the operating element and the outer periphery of the clamping body are embodied such that the foldable wall can be clamped at the first end thereof between the inner periphery of the operating element and the outer periphery of a clamping body;

the foldable wall is clamped at the first end thereof between the inner periphery of the operating element and the outer periphery of a clamping body.

These measures enable a particularly simple connection of the foldable wall to the operating element. Alternatively and in particular additionally, the first foldable wall can be sealed at the first end thereof to the operating element and/or the clamping body.

In a favourable embodiment hereof, wherein the dispensing container also comprises a displacing body, the clamping body comprises the displacing body. This measure makes it possible for the dispensing container to be formed from a smaller number of components.

A favourable embodiment of the dispensing container according to the invention also comprises a rotation blocking mechanism which is adapted such that the rotation of the first end of the foldable wall around the longitudinal axis of the frame by means of the operating element is free in a dispensing direction, and the rotation is blocked in the opposite direction.

This measure makes it possible after dispensing to avoid considerable untwisting of the foldable wall twisted during the dispensing. This blocking can be in blocked position immediately upon rotation in the opposite direction or can brought into blocked position during rotation in the opposite direction. In the latter case the reservoir is untwisted to some extent. This can have the advantage that the pressure of the liquid material on the dispensing opening generated during dispensing is removed so that undesirable exit out of the dispensing opening of liquid material from the reservoir after dispensing can be avoided.

In a favourable embodiment hereof, wherein the frame also comprises walls in which holes are arranged through which a portion of the operating element protrudes, the rotation blocking mechanism comprises a number of sawtooth-like blocking members arranged on the outer periphery of the operating element, wherein the dimensions of the operating element and of the holes in the walls of the frame through which the operating element protrudes are such that an edge of the holes comes into contact with a sawtooth during rotation of the operating element around the longitudinal axis. These measures enable a particularly simple and effective realization of a rotation blocking mechanism.

In an alternative embodiment hereof the rotation blocking mechanism comprises:

a first blocking element arranged on the frame and having an inner periphery which encloses a space, and a number of first blocking members protruding inward from the inner periphery thereof;

a second blocking element arranged on the reservoir and co-acting with the first blocking element and having a number of outward protruding blocking members on an outer periphery thereof;

wherein the second blocking element is positioned in the space enclosed by the first blocking element;

the first blocking members are one of blocking ribs and sawtooth-like blocking members and the second blocking members are the other of blocking ribs and sawtooth-like blocking members; and the dimensions of the first blocking element and of the second blocking element are such that one sawtooth-like blocking member at a time comes into contact with a blocking rib when the first end of the foldable wall is rotated around the longitudinal axis of the frame by means of the operating element. These measures enable a rotation blocking mechanism embodied separately of the operating element.

In a further favourable embodiment of the dispensing container according to the invention the dispensing container also comprises a closing element displaceable between a closing position and an open position relative to the dispensing opening, wherein in the closing position the closing element closes the dispensing opening of the reservoir, and in the open position the dispensing opening is clear of the closing element;

wherein the closing element is connected to the operating element and the frame via a movement-transmitting connecting construction;

wherein the movement-transmitting connecting construction is adapted such that in the closing position of the closing element a displacement of the closing element from the closing position to the open position is associated with a rotation of the operating element around the longitudinal axis of the frame in the dispensing direction;

in the open position of the closing element a displacement of the closing element from the open position to the closing position is associated with a rotation of the operating element around the longitudinal axis of the frame in the direction opposite to the dispensing direction;

in the open position of the closing element a displacement of the closing element from the open position to the closing position is disassociated from a rotation of the operating element around the longitudinal axis of the frame in the dispensing direction.

These measures make it possible, when the operating element is rotated, for the dispensing opening to be first opened and liquid material present in the reservoir to be subsequently dispensed from the dispensing opening and, when the operating element is rotated in opposite direction, for the dispensing opening to be reclosed.

In a favourable embodiment hereof the movement-transmitting connecting construction comprises:

a screw connection with which the closing element is connected to the operating element, the screw connection being adapted such that a rotation of the operating element around the longitudinal axis of the frame relative to the closing element results in a displacement of the closing element along the longitudinal axis of the frame; and a translation connection with which the closing element is connected to the frame, the translation connection being adapted such that a displacement of the closing element along the longitudinal axis of the frame is free and a rotation of the closing element relative to the frame around the longitudinal axis of the frame is blocked; and a coupling construction which is adapted in the open position of the closing element to uncouple at least one of the screw connection and the translation connection from the closing element such that a rotation of the closing element around the longitudinal axis of the frame is uncoupled from the relevant connection in one direction and is coupled in the opposite direction.

These measures enable a compact and robust closing mechanism.

In a favourable embodiment hereof, wherein the dispensing container also comprises the rotation blocking mechanism with sawtooth-like blocking elements, the dispensing container is embodied such that:

the second blocking element is the closing element; and in the closing position of the closing element, when the first end of the foldable wall is rotated around the longitudinal axis of the frame by means of the operating element, the sawtooth-like blocking members come into contact with a portion of the blocking ribs which is embodied such that a rotation of the second blocking element relative to the first blocking element is blocked in both rotation directions and that the second blocking element can be translated along the longitudinal axis so that, when the first end of the foldable wall is rotated around the longitudinal axis of the frame by means of the operating element in the dispensing direction, the second blocking element can be displaced from the closing position to the open position; and in the open position of the closing element, when the first end of the foldable wall is rotated around the longitudinal axis of the frame by means of the operating element, the sawtooth-like blocking members come into contact with a portion of the blocking ribs which is embodied such that a rotation of the second blocking element relative to the first blocking element is free in one direction and blocked in the opposite direction so that, when the first end of the foldable wall is rotated around the longitudinal axis of the frame by means of the operating element in the dispensing direction, the rotation of the second blocking element relative to the first blocking element is free.

In an alternative embodiment hereof the rotation blocking mechanism comprises:

a first blocking element arranged on the frame and having an inner periphery which encloses a space;

a second blocking element arranged on the reservoir and co-acting with the first blocking element;

wherein the second blocking element is arranged in the space enclosed by the first blocking element such that a rotation of the first blocking element relative to the second blocking element around the longitudinal axis of the frame is blocked and a translation of the first blocking element relative to the second blocking element along the longitudinal axis of the frame is free;

wherein the second blocking element is the closing element connected by means of a screw connection to the operating element;

wherein the screw connection comprises:

a multi-start screw thread wherein each of the thread windings comprises a guide groove arranged on one of the second blocking element and the reservoir; and a number of guide elements which are arranged on the other of the second blocking element and the reservoir and which each protrude into one of the guide grooves;

wherein in the closing position the second blocking element closes the dispensing opening of the reservoir and, when the first end of the foldable wall is rotated around the longitudinal axis of the frame by means of the operating element in the dispensing direction, the guide elements are guided through the guide grooves into which they protrude so that the second blocking element can be translated from the closing position to the open position;

in the open position the dispensing opening is clear of the second blocking element and the second blocking element is in contact with the first blocking element such that further translation of the second blocking element away from the closing position is blocked;

and wherein the reservoir and the second blocking element are embodied such that when the first end of the foldable wall is rotated around the longitudinal axis of the frame by means of the operating element in the dispensing direction in the open position of the second blocking element, the guide elements are pressed out of the guide grooves into which they protrude in the direction of a following guide groove; and that when the first end of the foldable wall is rotated around the longitudinal axis of the frame by means of the operating element in opposite direction in the open position of the second blocking element, the guide elements are guided through the guide grooves into which they protrude so that the second blocking element can be translated from the open position to the closing position.

These measures enable a particularly reliable mechanism, wherein during rotation of the operating element the dispensing opening is first opened and liquid material present in the reservoir is then dispensed from the dispensing opening and, when the operating element is rotated in opposite direction, the dispensing opening is once again closed. Use is made here of the principle that screw thread can slip when mutually engaging parts of the screw thread deform and/or can be displaced relative to each other such that the mutually engaging parts become detached from each other and engage with nearby parts of the screw thread.

In a favourable embodiment of the dispensing container according to the invention, wherein the second blocking element is arranged on the reservoir by means of a screw connection so that the second blocking element is displaceable relative to the reservoir along the longitudinal axis of the frame between a closing position and an open position, the dispensing container is embodied such that a core element is arranged in the dispensing opening such between the outer periphery of the core element and the inner periphery of the dispensing opening there is a space which communicates with the inner space enclosed by the foldable wall of the reservoir; and the second blocking element comprises an opening and a sliding wall enclosing the opening and extending along the wall enclosing the dispensing opening; wherein the inner periphery of the opening and the outer periphery of the core element are embodied such that in the closing position they are in closing contact with each other and that in the open position there is a space between the inner periphery of the opening and the outer periphery of the core element which communicates with the inner space enclosed by the foldable wall of the reservoir;

the sliding wall and the wall enclosing the dispensing opening are embodied such that they are in closing contact with each other in both the open position and the closing position.

These measures enable an effective closure in the case of a closing element which is carried by means of a translation along the longitudinal axis of the frame from the closing position to the open position, wherein a channel is moreover formed by means of the sliding wall between the opening in the second blocking element and the dispensing opening, so avoiding that liquid material dispensed from the dispensing opening does not find its way outside via the opening in the second blocking element.

In a further favourable embodiment of the dispensing container according to the invention the cross-sectional dimensions of the dispensing container are such that a hand of the user can grip round the dispensing container. This measure enables exceptionally simple operation with one hand.

The invention also relates to a method for forming a dispensing container according to the invention as described above, comprising the steps of

- manufacturing an elongate frame with a first end and a second end; and
- manufacturing an elongate reservoir with a foldable wall provided at a first end thereof with an operating element and a dispensing opening;
- connecting the first end of the foldable wall for rotation around a longitudinal axis of the frame by means of the operating element close to the first end of the frame; and
- connecting the second end of the foldable wall non-rotatably to the frame.

The present invention will be further elucidated hereinbelow on the basis of a number of exemplary embodiments of the dispensing container according to the invention which are shown schematically in the accompanying drawing. These are non-limitative exemplary embodiments. In the drawing.

Figure 1:
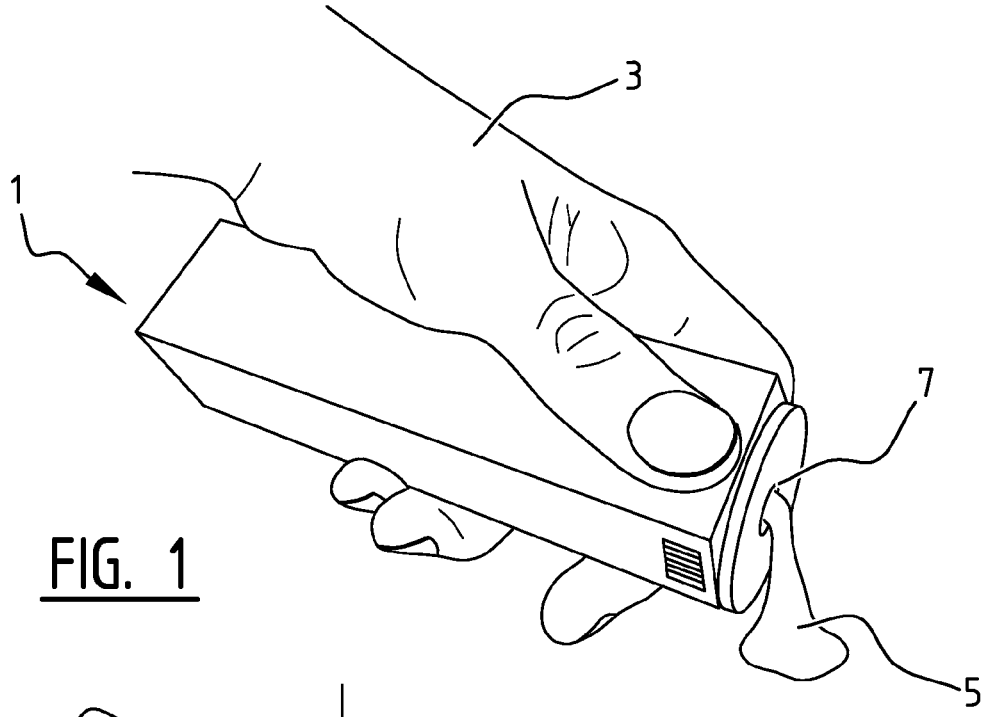
FIG. 1 is a perspective view of an embodiment of the dispensing container according to the invention in the hand of a user.

FIG. 1 shows an embodiment of a dispensing container 1 according to the invention while it is grasped by the hand 3 of a user and operated with this same hand 3 so that a quantity of liquid material 5, for instance a face cream, hand cream, toothpaste, a herbal paste and the like, flows out of dispensing opening 7.

Figure 2:
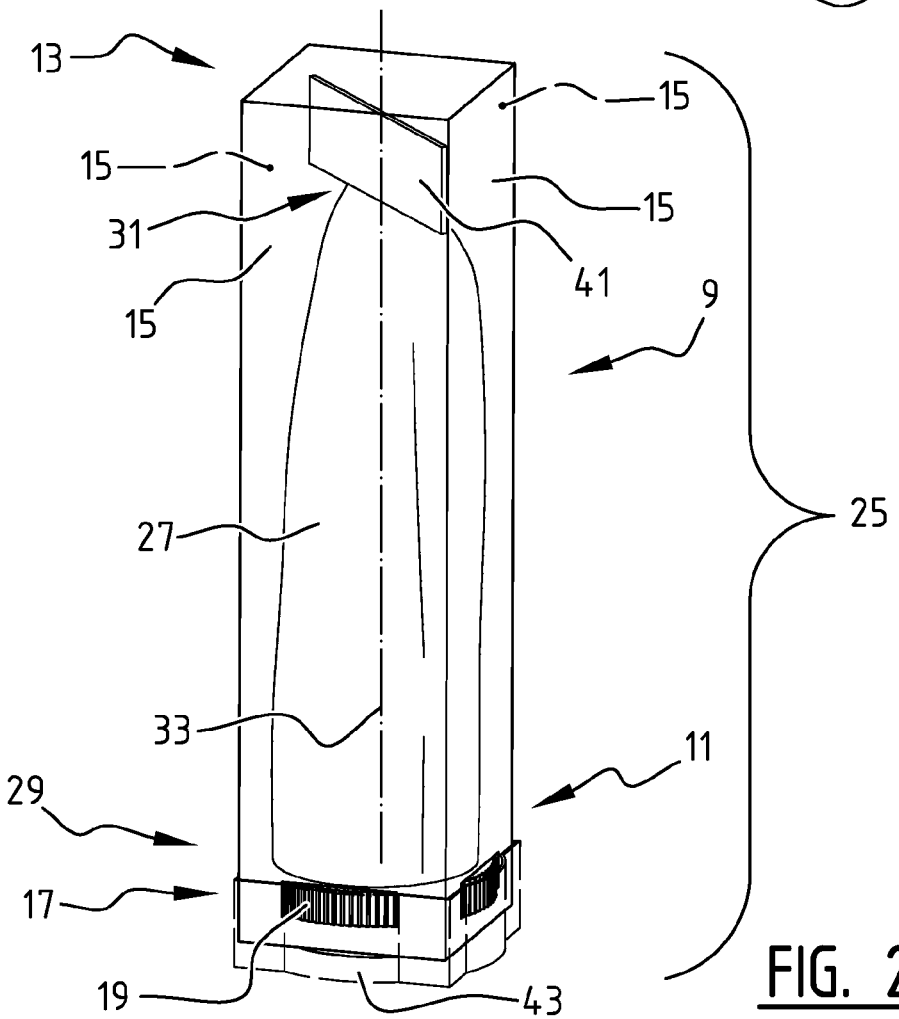
FIG. 2 is a partially cut-away perspective view of the dispensing container of FIG. 1.
Figure 3:
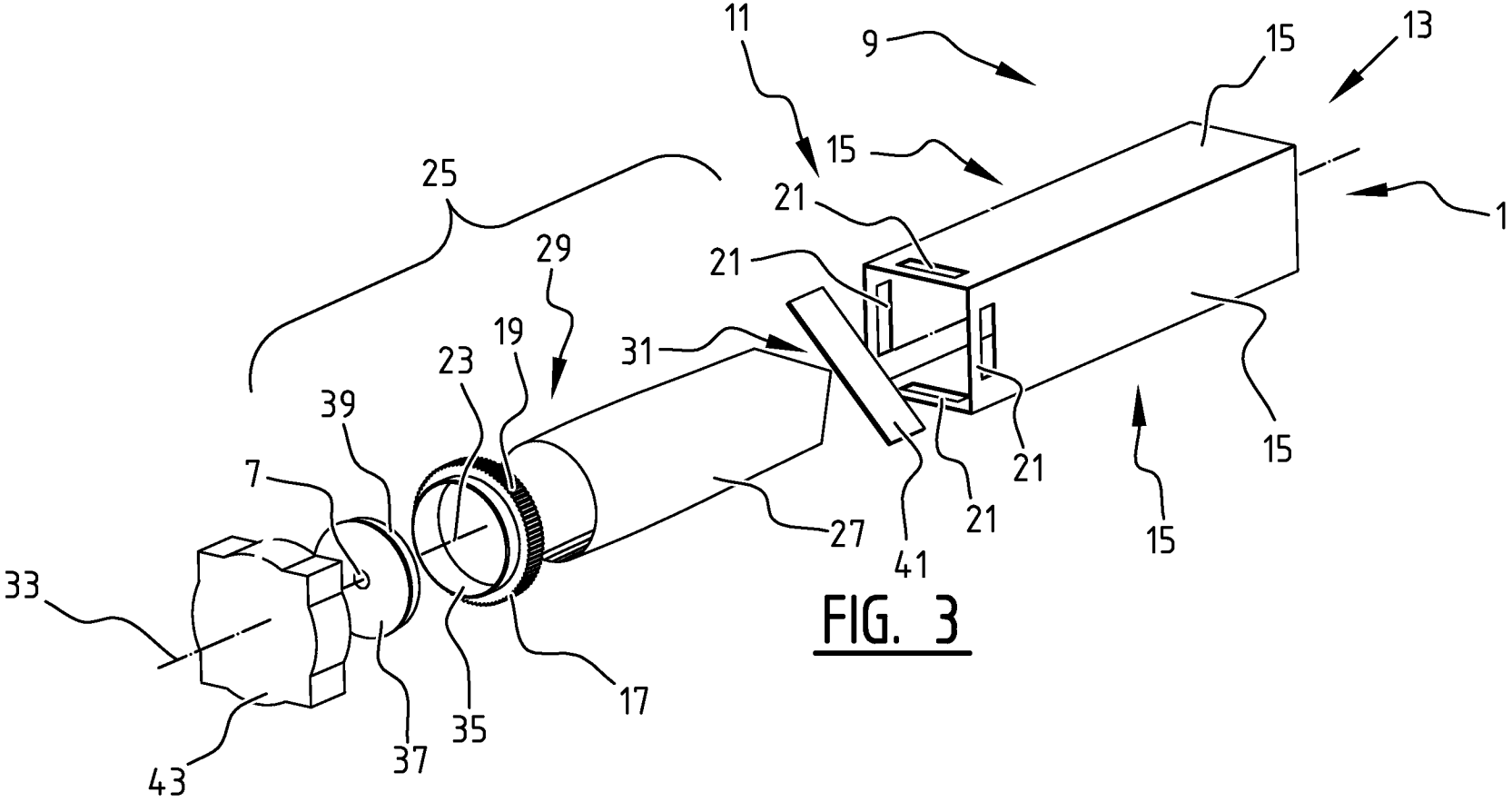
FIG. 3 is a perspective view with exploded parts of the dispensing container of FIG. 1.
Figure 4:
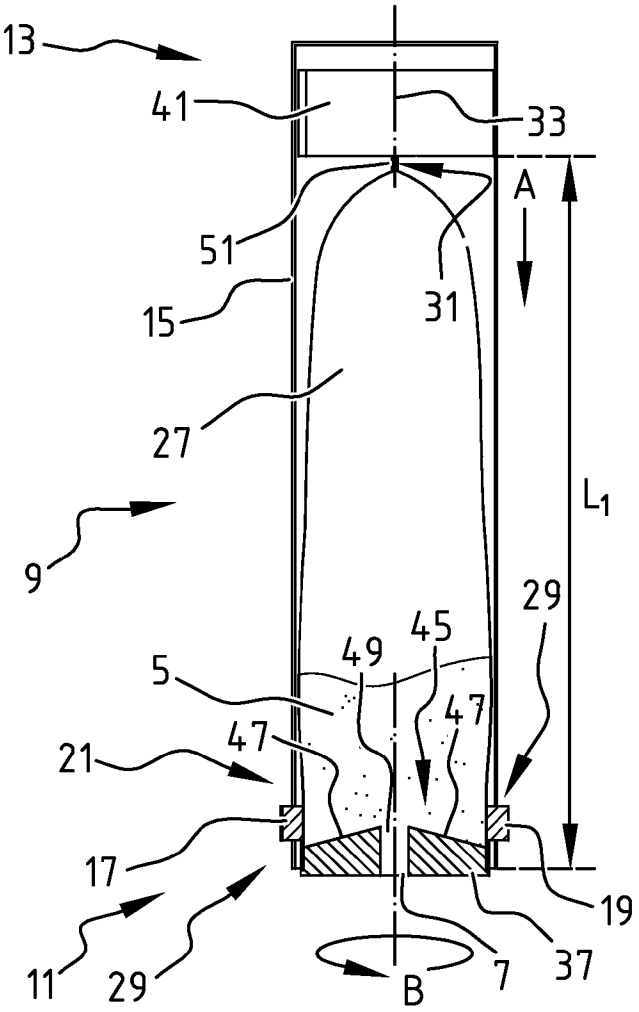

FIGS. 2, 3 and 4 show in detail the different components of dispensing container 1 of FIG. 1 and the relation between them. Shown is that dispensing container 1 has an elongate frame 9 with a first end 11 and a second end 13. Elongate frame 9 comprises a number of walls 15. The periphery of walls 15 has a polygonal, in particular square cross-section. As shown in FIG. 1, the cross-sectional dimensions of dispensing container 1 are such that a hand 3 of the user can grasp round dispensing container 1. FIG. 2 shows that dispensing container 1 is provided close to the first end 11 of the frame with an operating element 17 with a circular outer periphery 19. FIG. 3 shows that holes 21 are arranged in walls 15 of frame 9 close to the first end 11 thereof. The cross-sectional dimensions of the inner periphery of walls 15 of frame 9, of outer periphery 19 of operating element 17 and of holes 21 in walls 15 are such that, as shown in FIG. 2, a part of operating element 17 can be positioned in the space enclosed by walls 15 such that the centre 23 of operating element 17 is positioned in the space enclosed by walls 15 and at the position of holes 21 the outer periphery 19 of operating element 17 protrudes from holes 21. As shown in FIG. 1, the portion of operating element 17 protruding from holes 21 can be operated by the user using the fingers of hand 3.

Operating element 17 is part of a reservoir 25. Reservoir 25 also has a foldable wall 27 with a first end 29 and a second end 31.

Foldable wall 27 is connected at the first end 29 thereof to frame 9 for rotation around a longitudinal axis 33 of frame 9 close to the first end of frame 11 by means of operating element 17. As shown in FIG. 3, operating element 17 is annular and has an inner periphery 35. Reservoir 25 also has a clamping body 37 with an outer periphery 39. Inner periphery 35 of operating element 17 and outer periphery 39 of clamping body 37 are embodied, both being circular and each having a diameter, such that foldable wall 27 can be clamped at the first end 29 thereof between inner periphery 35 of operating element 17 and outer periphery 19 of clamping body 37. FIG. 4 shows that foldable wall 27 is clamped at the first end 29 thereof between the inner periphery of operating element 17 and the outer periphery of a clamping body 37.

Foldable wall 27 is connected non-rotatably to frame 9 at the second end 31 thereof by means of a guide element 41 displaceable along frame 9 in the direction A from the first end 29 of foldable wall 27.

FIGS. 2 and 3 also show that dispensing container 1 is provided with a cap 43 which can be placed over dispensing opening 7 and the portion of operating element 17 protruding from holes 21 in order to close dispensing opening 7 and avoid undesired operation of operating element 17.

FIG. 4 shows that clamping body 37 comprises a displacing body 45 with a number of displacement surfaces 47 running obliquely from first end 29 of foldable wall 27 in the direction of second end 21 of foldable wall 27. Displacement surfaces 47 can be formed by means of a conical displacing body with a continuous displacement surface or a number of discrete displacement surfaces. As shown in FIG. 4, displacement surfaces 47 form at the end remote from foldable wall 27 an opening of a dispensing channel 49 to dispensing opening 7 situated close to first end 11 of frame 9. Reservoir 25 has a constriction 51 close to second end 31 of foldable wall 27. As shown in FIG. 4, the space enclosed by foldable wall 27 is filled with a liquid material 5.

Figure 6:
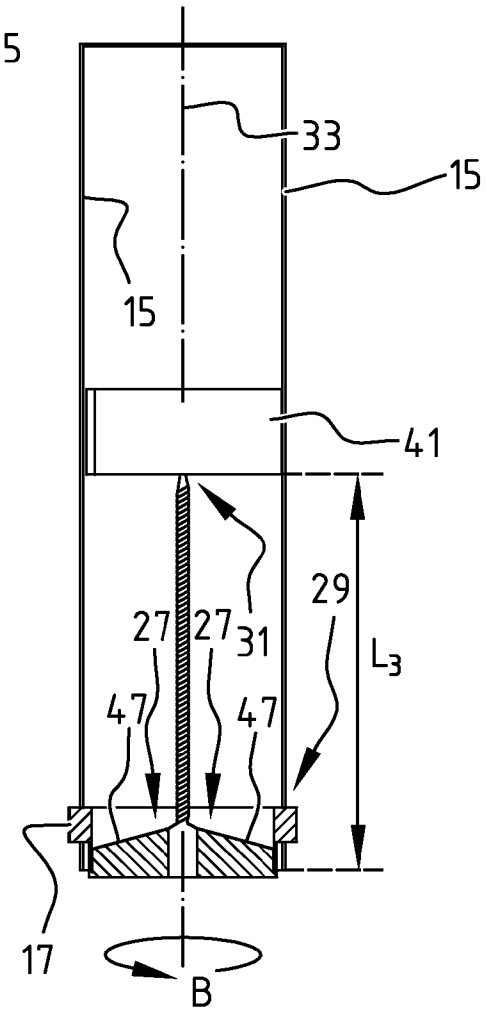
FIGS. 4-6 show a longitudinal section of the dispensing container of FIG. 1 at different stages during use thereof.
Figure 5:
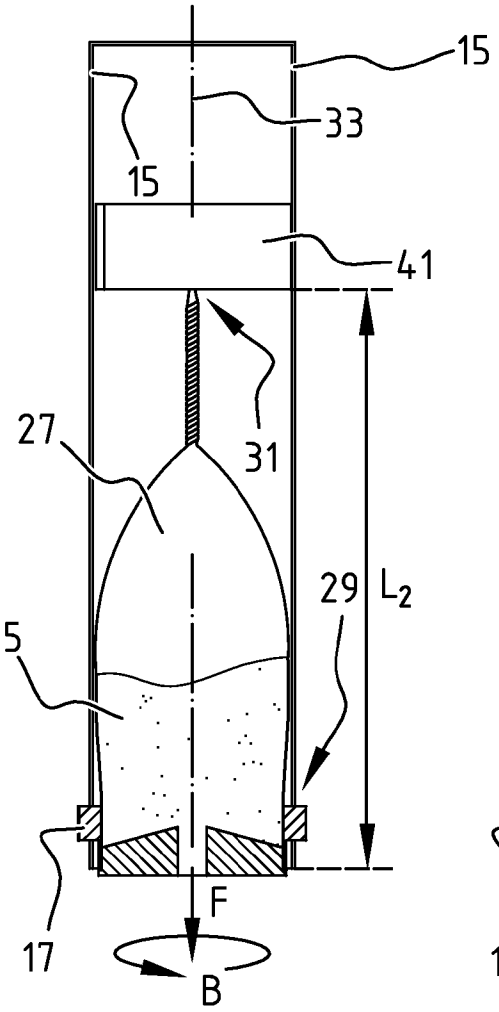

From the situation as shown in FIG. 4 the first end 29 of foldable wall 27 can be rotated around longitudinal axis 31 of frame 9 in the dispensing direction B by means of operating element 17. Because foldable wall 27 is connected non-rotatably to frame 9 at the second end 31 thereof, a twisting of foldable wall 27 occurs here close to the second end 31 thereof. This twisting is enhanced in that reservoir 25 has a constriction 51 close to second end 31 of foldable wall 27. The more the first end 29 of foldable wall 27 is rotated around longitudinal axis 31 in the dispensing direction B by means of operating element 17, the further the foldable wall 27 is twisted in the direction A of first end 29 of foldable wall 27, as shown in FIGS. 5 and 6. The content of the reservoir, i.e. the liquid material 5 present in the space enclosed by foldable wall 27, is then forced in the direction of dispensing opening 7 so that, when the situation as shown in FIG. 6 is reached, practically the whole content of reservoir 25 has been carried via dispensing opening 7 out of reservoir 25 in the direction of arrow F. As also shown in FIGS. 5 and 6, the length $L_1$, $L_2$, $L_3$ of foldable wall 27 decreases as it is twisted. In order to compensate for this decrease in the length L the guide element 41 can displace along frame 9 in the direction A of first end 29 of foldable wall 27. Alternatively, the walls 15 of frame 9 between first end 29 of foldable wall 27 and second end 31 of foldable wall 27 can be shortened in length, for instance the walls are slidable together or foldable together in order to compensate for the decrease in length L. The second end 31 of foldable wall 27 need in that case not be connected via a displaceable guide element 41 to frame 9. In the situation as shown in FIG. 6, foldable wall 27 lies close to the first end 29 thereof against displacement surfaces 47. Displacing body 45 is optional. However, without the displacing body 45 it may occur that in the situation as shown in FIG. 6, in which no further rotation of first end 29 of foldable wall 27 around longitudinal axis 33 is possible, a space with liquid material 5 will remain between foldable wall 27 and the bottom of the space enclosed by foldable wall 27.

Figure 7:
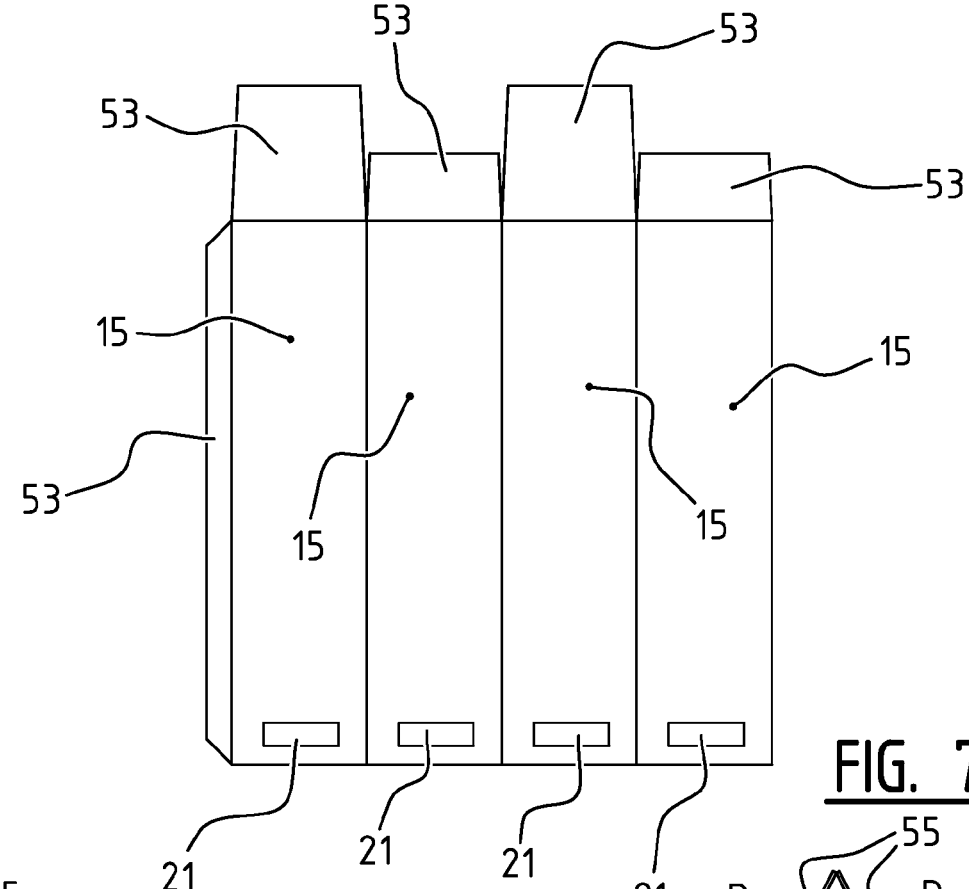
FIG. 7 shows a view of a blank of the frame of the dispensing container of FIG. 1.

FIG. 7 shows a blank of frame 9 of FIGS. 1-6. Shown is that frame 9 with walls 15, holes 21, and assembly tabs 53 can be manufactured from one piece of starting material. Alternatively, the frame can be manufactured for instance by means of an injection moulding process.

FIGS. 8-11 show several alternative embodiments of guide element 41 as shown in FIGS. 2-6.

Figure 8:
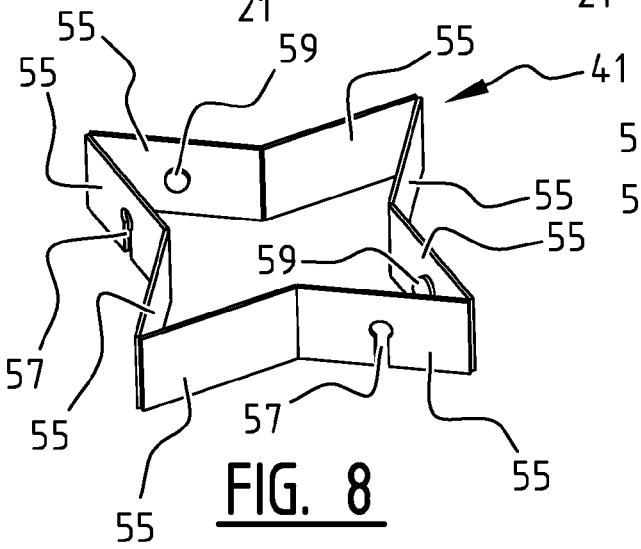
FIGS. 8-11 show different views of alternative embodiments of the guide element of the dispensing container of FIG. 1.
Figure 9A:
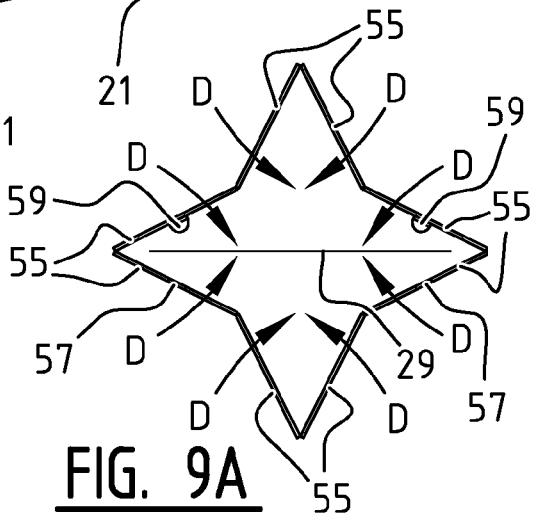
Figure 9B:
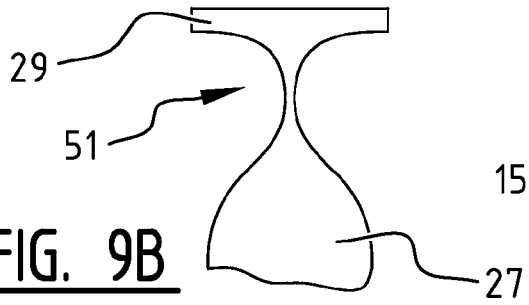
Figure 9C:
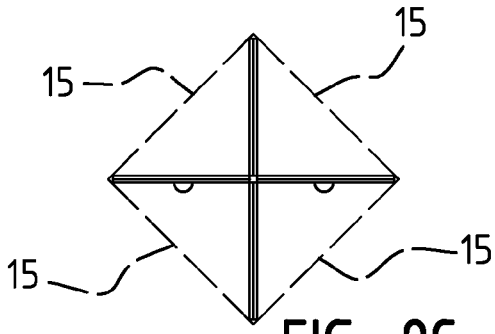

Shown in FIGS. 8 and 9A is a guide element 141 in a situation before it is connected to second end 31 of foldable wall 27. This guiding element 141 is constructed from eight wall parts 55, all of the same dimensions, connected pivotally to each other to form a closed polygon. As shown in FIG. 8, two of the wall elements 55 are provided with recesses 57 and two other wall parts 55 are provided with protruding connecting members 59 which can be placed in recesses 57. By positioning the second end 29 of flexible wall 27, which is formed for instance as shown in FIG. 9B, between wall parts 55 and subsequently bringing wall parts 55 together in the direction of arrows D so that the protruding connecting members 59 can be placed together with a part of the second end 29 of the foldable wall into recesses 57 the situation as shown in FIG. 9C is realized in which the second end 29 of foldable wall 27 is connected to guide element 141. As shown in FIG. 9C, guide element 141 can be positioned between walls 15 of the frame, wherein guide element 141 is in contact with the frame in the corners where walls 15 come together.

Figure 10:
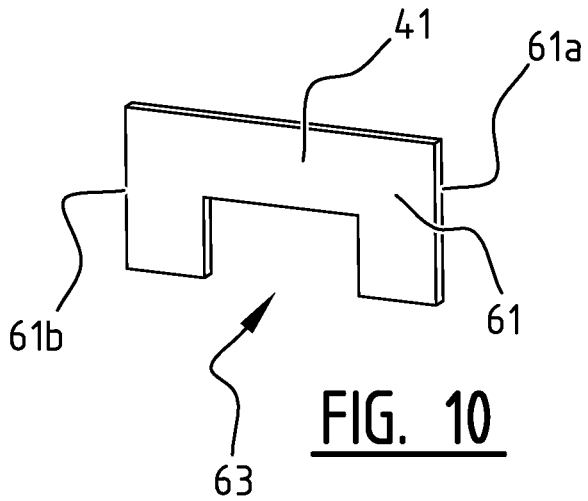

FIG. 10 shows a further alternative embodiment of guide element 41 as shown in FIGS. 2-6. Guide element 41 shown in FIG. 10 is constructed from a single wall part 61 with a recess 63 therein. Recess 63 provides space for the constriction 51 at the second end of foldable wall 27. The relatively long sides 63*a* and 63*b* of wall part 63 provide a stable contact with walls 15 of frame 9 and thereby avoid loss of alignment of the guide element.

Figure 11:
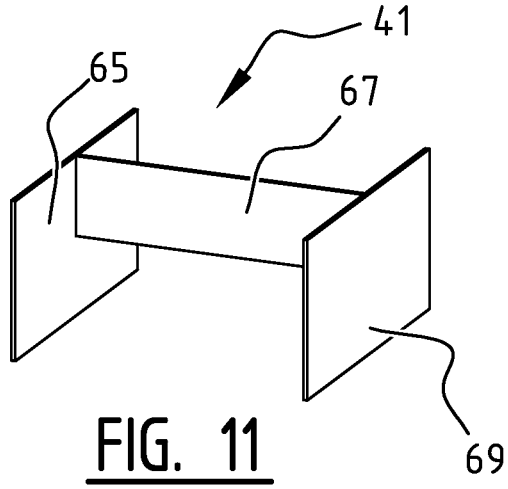

FIG. 11 shows a variant of the embodiment of guide element 41 as shown in FIG. 10. Guide element 41 shown in FIG. 11 is constructed from three wall parts 65, 67, 69, wherein wall parts 65 and 69 extend perpendicularly relative to wall part 67 on both short sides of wall part 67.

Figure 12:
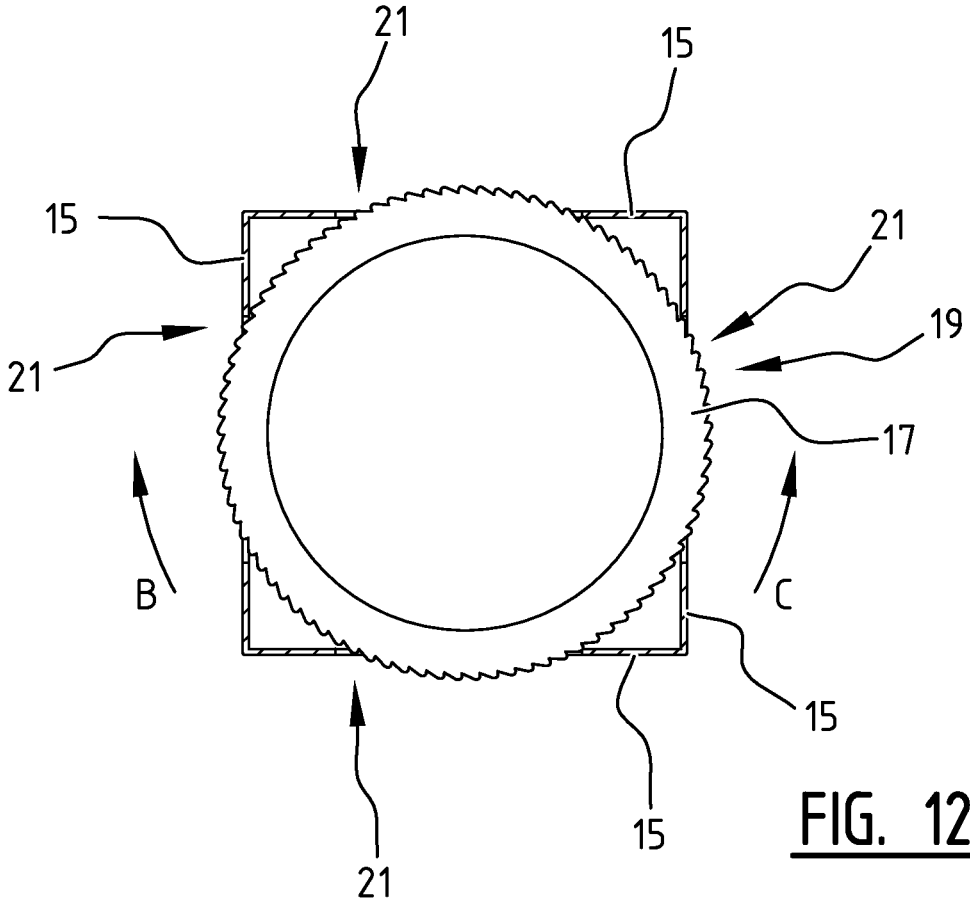
FIG. 12 shows a cross-section of the dispensing container of FIG. 1 at the position of the operating element.

FIG. 12 shows a cross-section of dispensing container 1 of FIGS. 1-6 through operating element 17 for the purpose of describing a rotation blocking mechanism embodied in dispensing container 1. This rotation blocking mechanism comprises a number of sawtooth-like blocking members arranged on outer periphery 19 of operating element 17, wherein the dimensions of the operating element, in particular the diameter of the circular outer periphery thereof, and the dimensions of the holes 21 in walls 15 of the frame through which operating element 17 protrudes are such that an edge of holes 17 comes into contact with a sawtooth during rotation of the operating element around longitudinal axis 33. In the shown embodiment the sawteeth are oriented such that a rotation of operating element 17 in the dispensing direction B is free in that, due to a gradual outward bending of the edge of holes 21 with which the oblique side comes into contact, it is possible to move the oblique side of a sawtooth along the edge, while a rotation of operating element 17 in the opposite direction C is blocked in that the straight side of a sawtooth cannot be moved along an edge with which it comes into contact. Hereby realized is that a rotation of the first end of foldable wall 27 around longitudinal axis 33 in dispensing direction B by means of operating element 17, and thereby the twisting of second end 31 of foldable wall 27 and dispensing of liquid material from reservoir 25 are possible, while the rotation of first end 29 of foldable wall 27 around longitudinal axis 33 in the opposite direction C, in which the second end 31 of foldable wall 27 is untwisted, is blocked.

FIGS. 13-23 show an alternative embodiment of dispensing container 1 of FIGS. 1-6.

Figure 13:
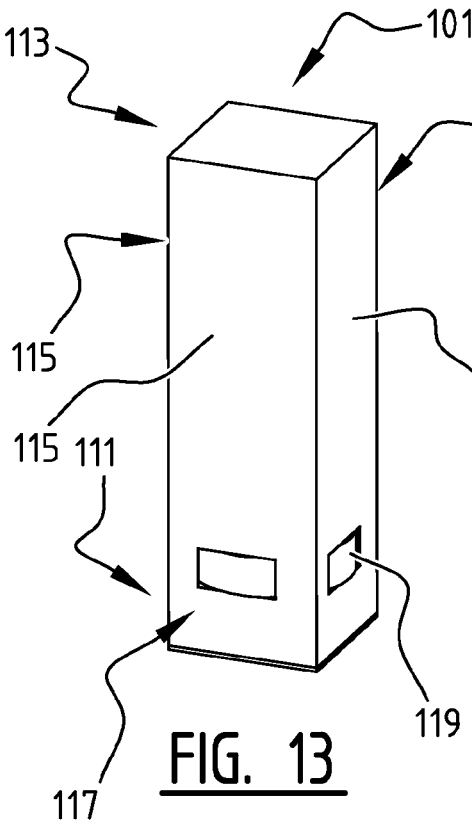
FIG. 13 is a perspective view of an alternative embodiment of the dispensing container of FIG. 1.
Figure 14:
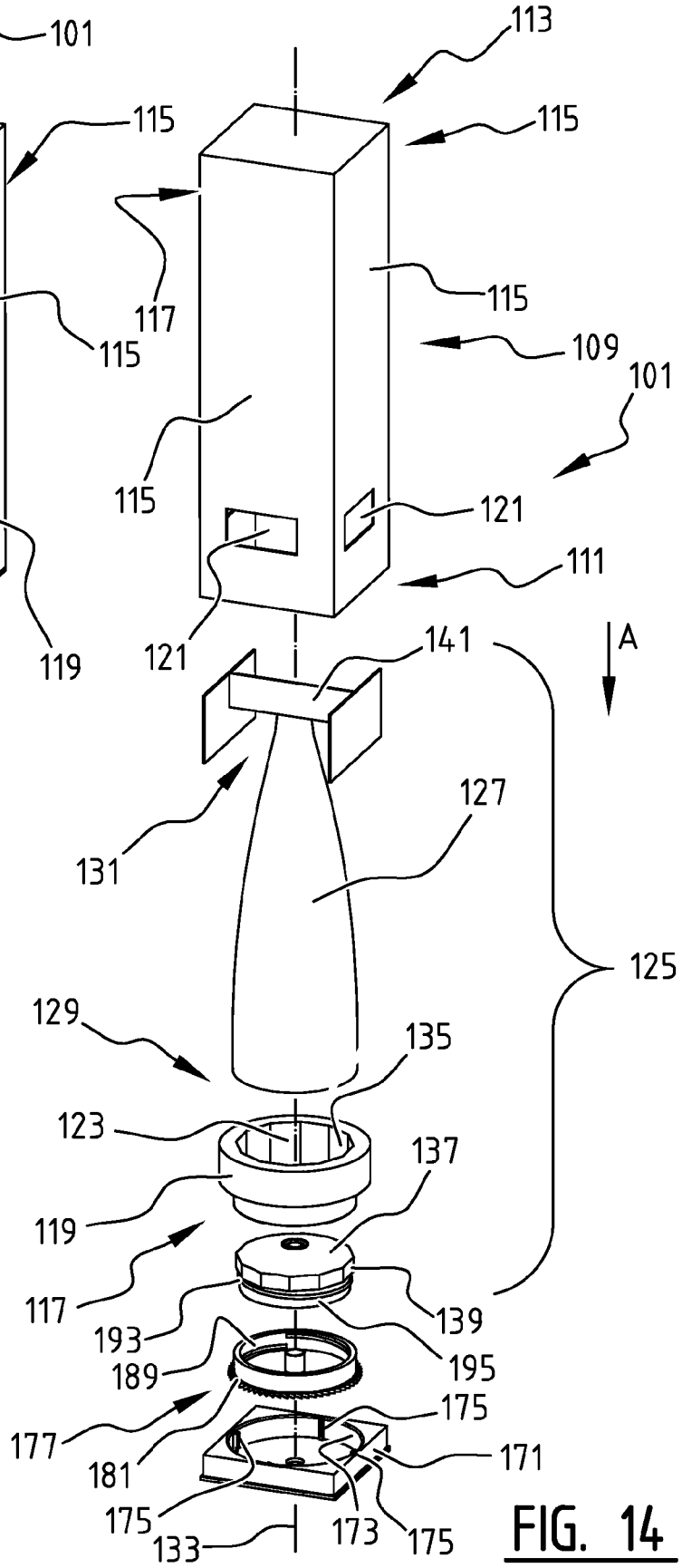
FIG. 14 is a perspective view with exploded parts of the dispensing container of FIG. 13.

FIGS. 13 and 14 show a dispensing container 101 having an elongate frame 109 with a first end 111 and a second end 113. Elongate frame 109 comprises a number of walls 115. The periphery of walls 115 has a polygonal, in particular square cross-section. As in the case of dispensing container 1 of FIG. 1, the cross-sectional dimensions of dispensing container 101 are such that it is possible for a hand of the user to grip round dispensing container 101. FIG. 13 shows that dispensing container 101 is provided close to first end 111 of frame 109 with an operating element 117 with a circular outer periphery 119. FIG. 14 shows that holes 121 are arranged in walls 115 of frame 109 close to first end 111 thereof. The cross-sectional dimensions of the inner periphery of walls 115 of frame 109, of outer periphery 119 of operating element 170 and of holes 121 in walls 115 are such that, as shown in FIG. 13, a part of operating element 117 can be positioned in the space enclosed by walls 115 such that the centre 123 of operating element 117 is positioned in the space enclosed by walls 115, and at the position of holes 121 the outer periphery 119 of operating element 117 protrudes from holes 121. Just as in the case of dispensing container 1 shown in FIG. 1, the portion of operating element 117 protruding from holes 121 can be operated by the user using the fingers of the hand.

Operating element 117 is part of a reservoir 125. Reservoir 125 also has a foldable wall 127 with a first end 129 and a second end 131.

Foldable wall 127 is connected at first end 129 thereof to frame 109 for rotation around a longitudinal axis 133 of frame 109 close to the first end of frame 111 by means of operating element 117. As shown in FIG. 14, operating element 117 is annular and has an inner periphery 135. Reservoir 125 also has a clamping body 137 with an outer periphery 139. Inner periphery 135 of operating element 117 and outer periphery 139 of clamping body 137 are embodied, both being polygonal and having dimensions, such that foldable wall 127 can be clamped at the first end 129 thereof between inner periphery 135 of operating element 117 and outer periphery 119 of clamping body 137.

Foldable wall 27 is connected non-rotatably to frame 109 at the second end 131 thereof by means of a guide element 141 displaceable along frame 109 in the direction A from the first end 129 of foldable wall 127.

The operating principle of dispensing container 101 is the same as the operating principle of dispensing container 1 as shown in FIGS. 4-6. Frame 101 can also be formed from a blank as shown in FIG. 7. Guide elements 41 of FIGS. 1-6 and 8-10 are an alternative to the guide element 141 as applied in FIG. 14.

Dispensing container 101 is not provided with the cap as shown in the case of dispensing container 1 in FIG. 2 and not provided with the rotation blocking mechanism as shown in FIG. 12. Dispensing container 101 is provided instead with an alternative rotation blocking mechanism and dispensing container 101 provides for an alternative method of closing the dispensing opening. Dispensing container 101 as shown in FIG. 14 is provided for this purpose with a first blocking element 171 which is arranged on frame 109 and has an inner periphery 173 enclosing a space, and a number of first blocking members in the form of blocking ribs 175 protruding inward from the inner periphery 173 thereof. Dispensing container 101 is also provided with a second blocking element 177 which is arranged on reservoir 25, co-acts with first blocking element 171 and has on an outer periphery 179 thereof a number of outward protruding, second blocking members in the form of sawtooth-like blocking members 181.

Figure 15:
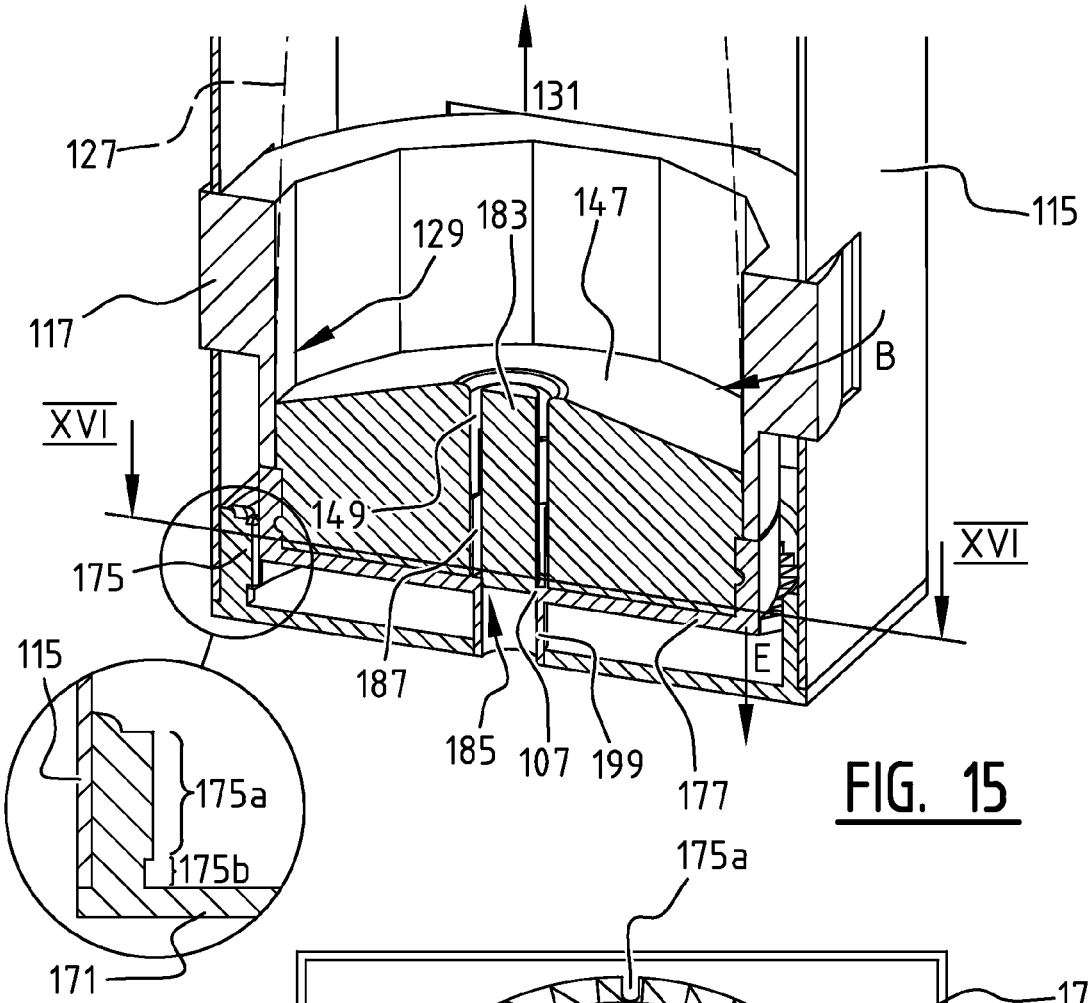
FIG. 15 shows a perspective longitudinal section of a detail of the dispensing container of FIG. 13 with the second blocking element in the closing position.

FIG. 15 shows a detail in longitudinal section of the first end 111 of dispensing container 101. Shown is that, just as in the case of dispensing container 1 as shown in FIG. 4, foldable wall 127 is clamped at the first end 129 thereof between the inner periphery of operating element 117 and the outer periphery of a clamping body 137. Also shown is that, just as in the case of dispensing container 1 as shown in FIG. 4, clamping body 137 comprises a displacing body 145 with a number of, in this embodiment one, displacement surfaces 147 running obliquely from first end 129 of foldable wall 127 in the direction of second end 131 of foldable wall 127. As shown in FIG. 15, displacement surface 147 forms at the end remote from foldable wall 127 an opening of a dispensing channel 149 to dispensing opening 107 which is situated close to first end 111 of frame 109.

A core element 183 is arranged in dispensing channel 149 and dispensing opening 107 such that between the outer periphery of the core element and the inner periphery of dispensing opening 107 and the inner periphery of dispensing channel 149 there is a space which communicates with the inner space enclosed by foldable wall 127 of the reservoir.

The second blocking element 177 has an opening 185 and a sliding wall 187 which encloses opening 185 and extends in the space between the outer periphery of core element 183 and the inner periphery of dispensing opening 107. The inner periphery of opening 185 and the outer periphery of core element 183 are embodied such that, in the shown closing position of second blocking element 177, they are in closing contact with each other so that reservoir 125 is closed. Second blocking element 177 is hereby a closing element.

Arranged on an inner periphery 189 of the second blocking element 177 as shown in FIG. 14 is a thread winding 191 which co-acts with a thread winding 193 arranged on an outer periphery 195 of clamping body 137 so that second blocking element 177 can be arranged by means of a screw connection on reservoir 125, as shown in FIG. 15. The screw connection is embodied such that, by means of a rotation of reservoir 125 around longitudinal axis 133 of frame 109 relative to second blocking element 177 by means of operating element 117, second blocking element 177 can be displaced relative to reservoir 125 along the longitudinal axis 133 of frame 109 between the closing position shown in FIG. 15 and an open position.

As shown in the detail view inset by FIG. 15, blocking rib 175 has a first portion **175*a* and a second portion 175*b*, wherein the first portion 175*a* protrudes further inward than the second portion 175*b*. Owing to these two portions 175*a*, 175*b* the blocking rib 175 has a reverse L-shaped tooth form. Although a blocking rib of reverse L-shaped tooth form is particularly effective, blocking rib 175** could also protrude equally far over the whole length thereof.

Figure 16:
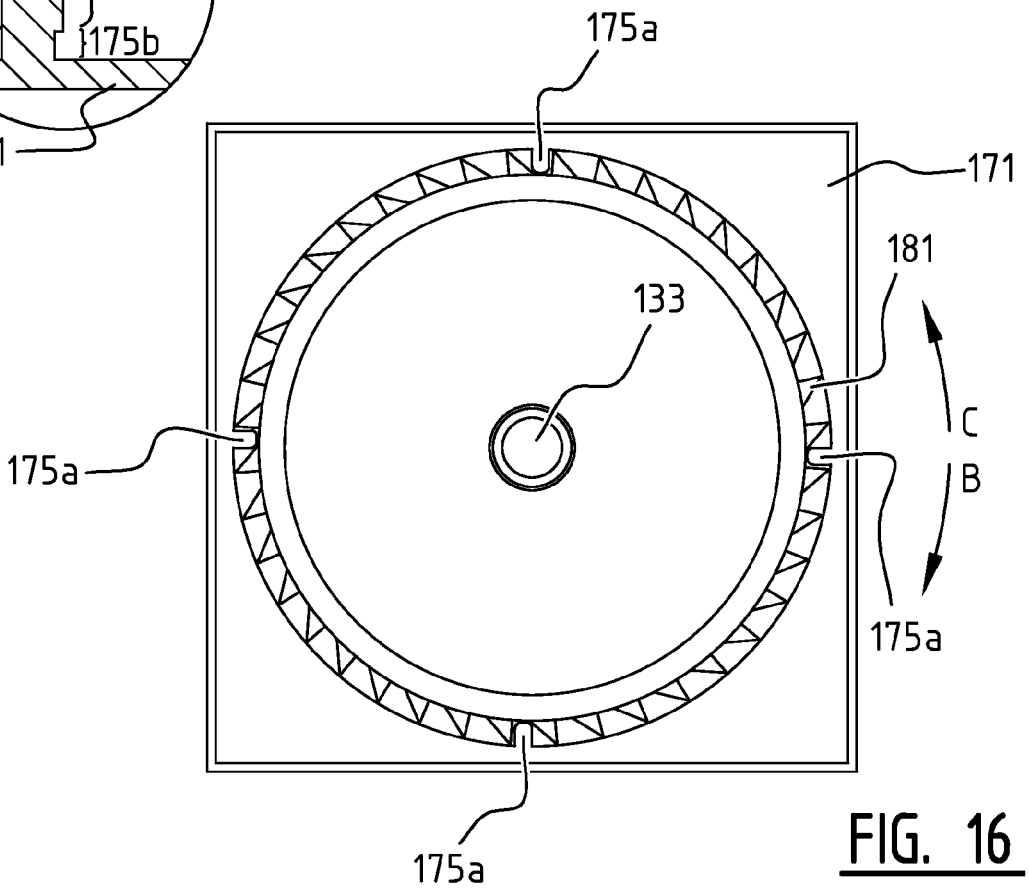
FIG. 16 shows a cross-section of the dispensing container of FIG. 13 at the position of the second blocking element, with the second blocking element in the closing position.
Figure 17:
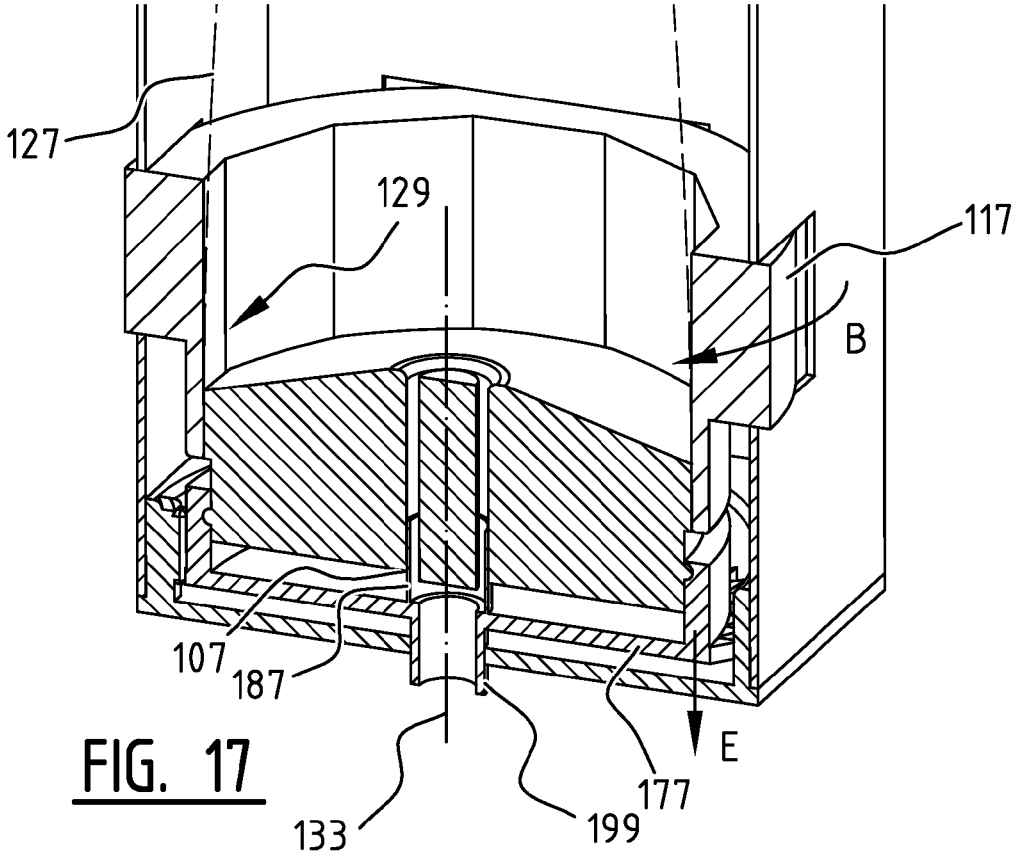
FIG. 17 shows a perspective longitudinal section of the detail of the dispensing container of FIG. 13, with the second blocking element between the closing position and the open position.
Figure 18:
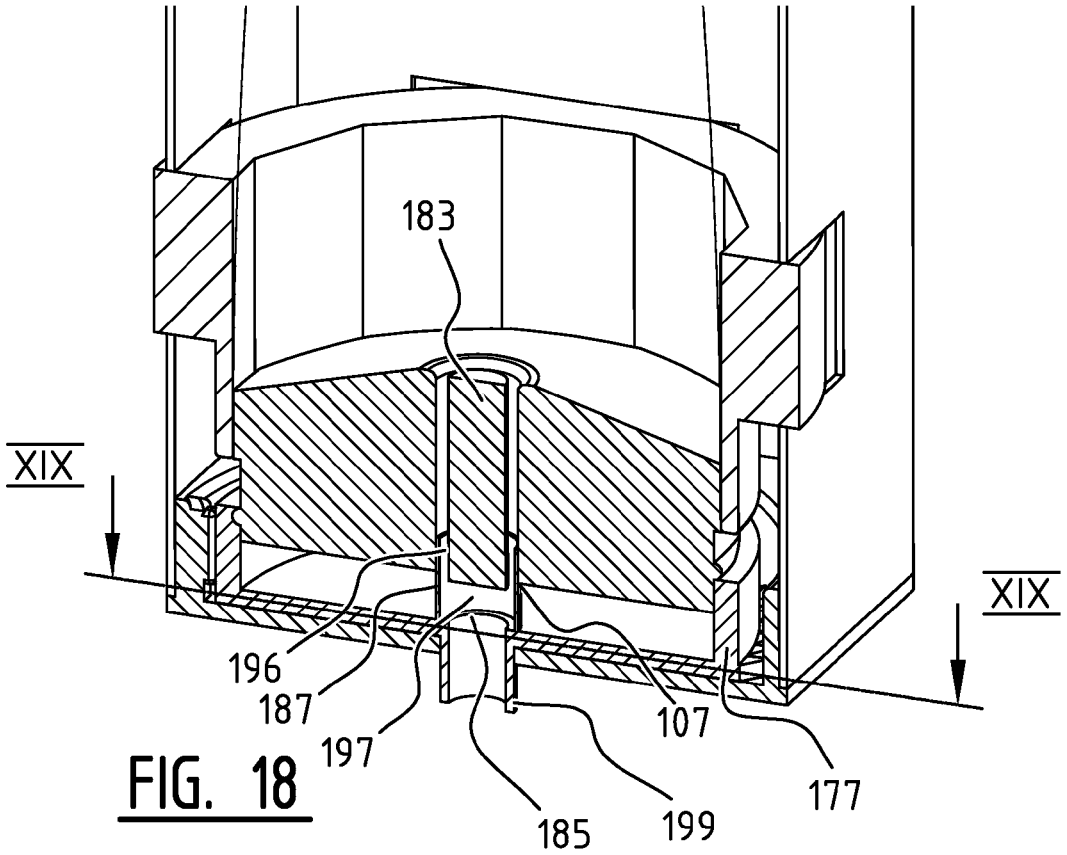
FIG. 18 shows a perspective longitudinal section of the detail of the dispensing container of FIG. 13 with the second blocking element in the open position.

As shown in FIG. 16, when first end 129 of foldable wall 127 is rotated around longitudinal axis 133 of frame 109 by means of operating element 117 in the dispensing direction B or the opposite direction C, the sawtooth-like blocking members 181 come in the closing position into contact with the first portion **175*a* of blocking ribs 175 of first blocking element 171 which is embodied such that a rotation of second blocking element 177 relative to first blocking element 171 is locked in both rotation directions B and C. Second blocking element 177 is however translatable along longitudinal axis 133 in direction E so that, as shown in FIG. 17, when first end 129 of foldable wall 127 is rotated around longitudinal axis 133 of frame 109 by means of operating element 117 in dispensing direction B, second blocking element 177, as a result of the screw connection between clamping body 137 and second blocking element 177, translates from the closing position in the direction of arrow E to the open position shown in FIG. 18. In the open position there is a space 197 between the inner periphery of opening 185 of second blocking element 177 and the outer periphery of core element 183, this space 197 communicating with the inner space enclosed by foldable wall 127 of the reservoir. As shown in FIGS. 16-18, the outer periphery of the sliding wall and the edge of dispensing opening 107 are embodied such that they are in closing contact with each other in both the open position and the closing position. FIGS. 16-18 also show that a second wall 199 encloses the opening 185 of second blocking element 177 which extends from a side of second blocking element 177** opposite the side from which sliding wall 187 extends. When second blocking element 177 is translated from the closing position to the open position, the second wall 199 slides outward in the direction of arrow D and here forms a spout which has the function of enabling easy removal and wiping away of dispensed liquid material. Second wall 199 can be a flexible, for instance silicone wall.

Because there is in the open position shown in FIG. 18 a space 196 between the inner periphery of sliding wall 187 and the outer periphery of core element 183 and there is a space 197 between the inner periphery of opening 185 of second blocking element 177 and the outer periphery of core element 183, these spaces 196 and 197 communicating with the inner space enclosed by foldable wall 127 of the reservoir, in the open position the dispensing opening 107 is clear of second blocking element 177 so that liquid material in the space enclosed by foldable wall 127 can be carried out of reservoir 125.

Figure 19:
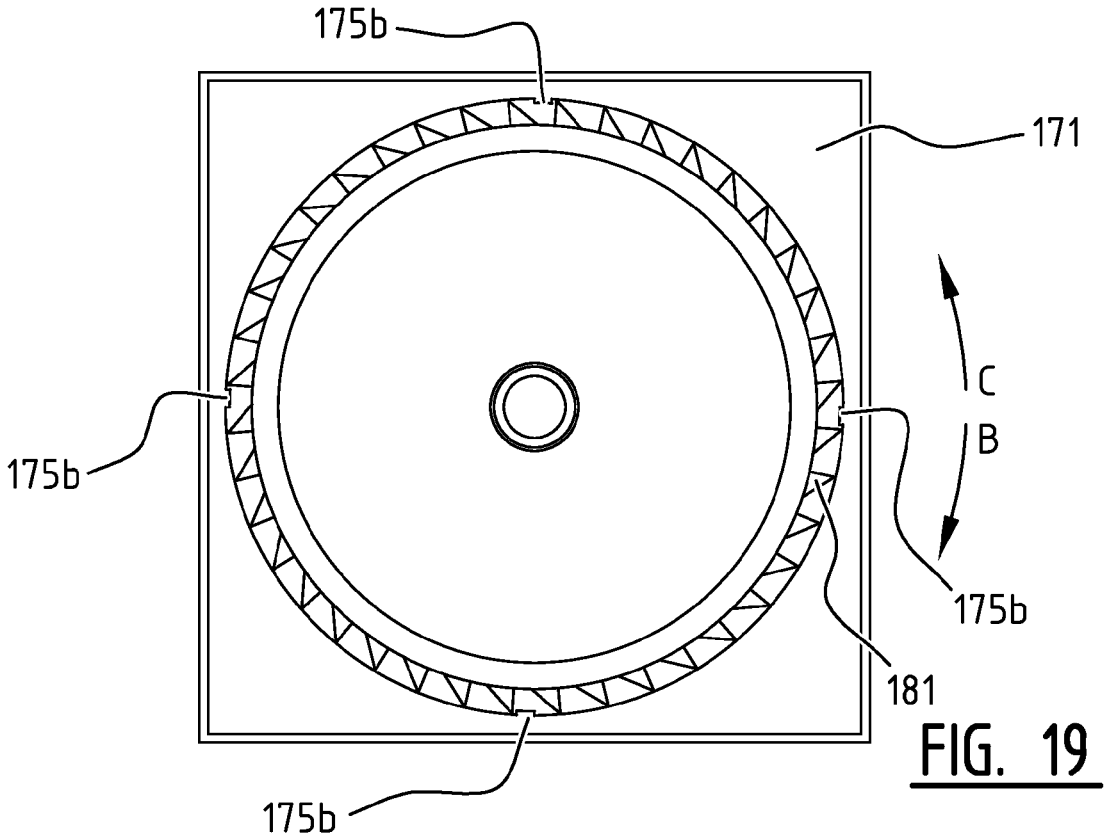
FIG. 19 shows a cross-section of the dispensing container of FIG. 13 at the position of the second blocking element, with the second blocking element in the open position.
Figure 20:
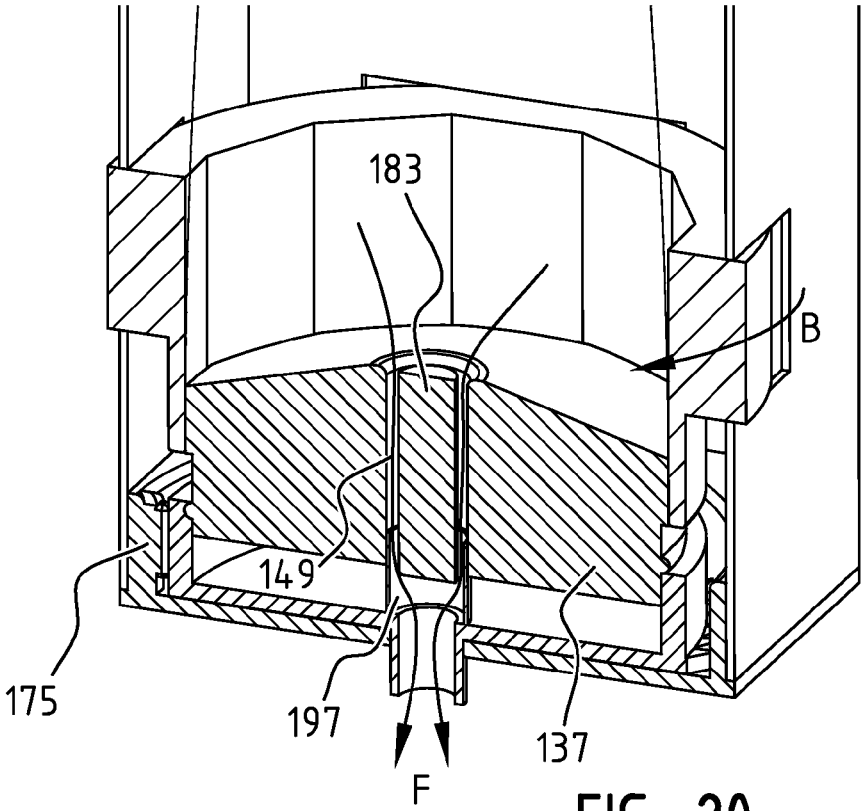
FIGS. 20-23 show different perspective views of the dispensing container of FIG. 13 during use thereof.
Figure 21:
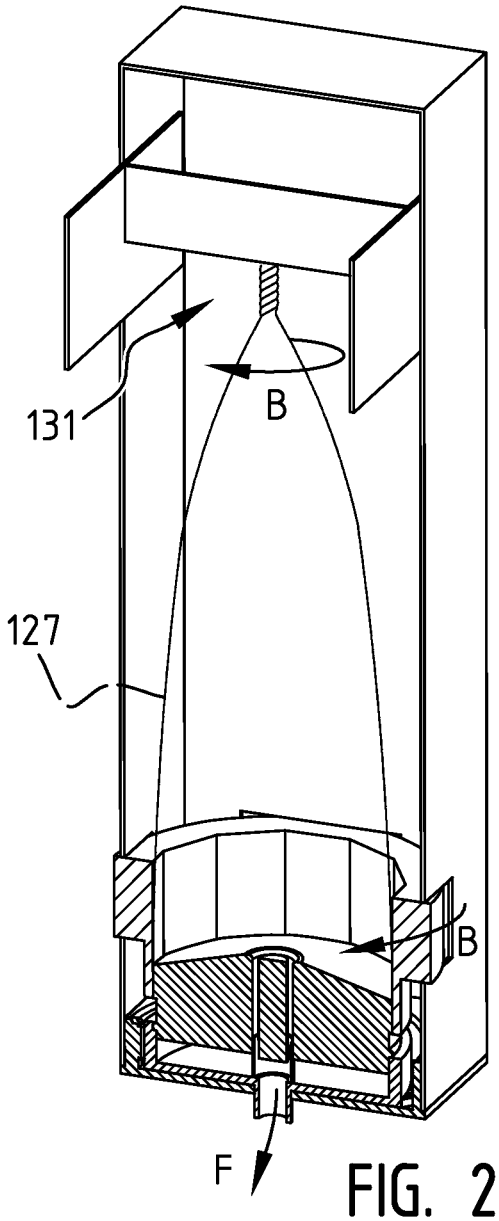

As shown in FIG. 19, when first end 129 of foldable wall 127 is rotated around longitudinal axis 133 of frame 109 by means of operating element 117, the sawtooth-like blocking members 181 come in the open position into contact with the second portion 175*b* of blocking ribs 175 which is embodied, in this case protrudes less far into the space between sawtooth-like blocking members 181 than in the closing position as shown in FIG. 16, such that a rotation of second blocking element 177 relative to first blocking element 171 is free in dispensing direction B and is blocked in the opposite direction C. When the first end of foldable wall 127 is rotated around longitudinal axis 133 of frame 109 by means of operating element 117 in dispensing direction B, the rotation of second blocking element 177 relative to the first blocking element is free as a result. By rotating the first end of foldable wall 127 around longitudinal axis 133 of frame 109 by means of operating element 117 in dispensing direction B with the second blocking element 177 in the open position, foldable wall 127 is, as shown in FIGS. 20 and 21, twisted at the second end 131 thereof. The liquid material present in the space enclosed by foldable wall 127 is then forced in the direction of dispensing channel 149 in clamping body 137, and can then flow via the space between the inner periphery of dispensing channel 149 and the outer periphery of core element 183 and via the space 197 between the inner periphery of opening 185 of second blocking element 177 and the outer periphery of core element 183 out of reservoir 125 as indicated with arrows F.

Figure 22:
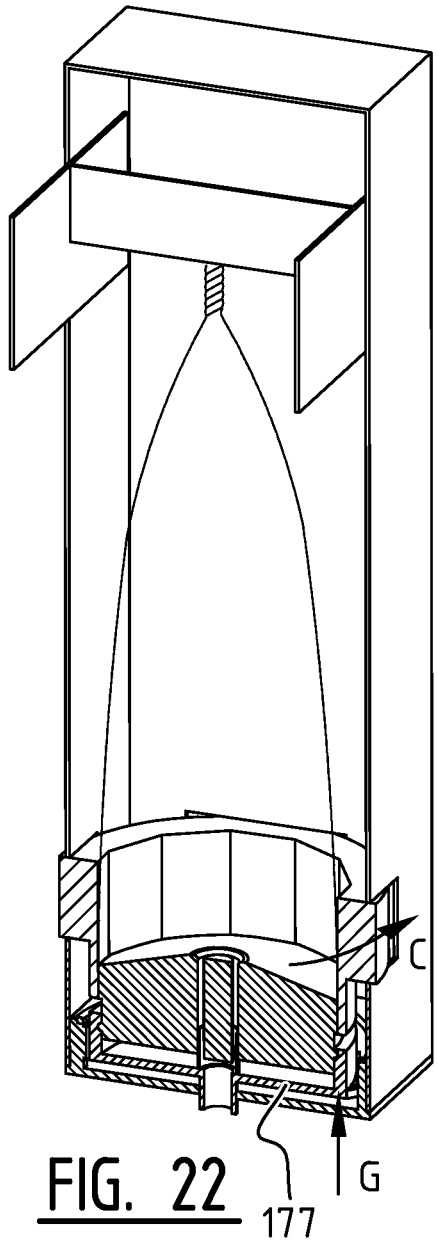
Figure 23:
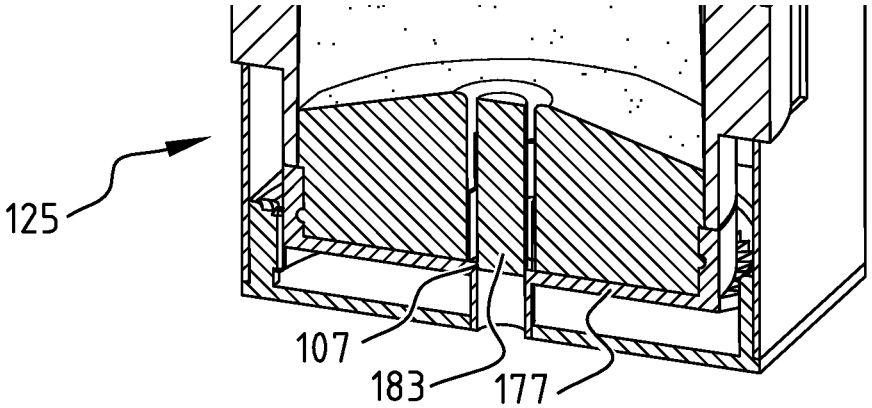

By rotating the first end 127 of foldable wall 127 around longitudinal axis 133 of frame 109 by means of operating element 117 in the direction C opposite to the dispensing direction as shown in FIG. 22 from the open position of second blocking element 177 and after carrying a quantity of liquid material out of reservoir 125, second blocking element 177 translates in the direction of arrow G to the closing position as shown in FIGS. 15 and 23 so that dispensing opening 107 of reservoir 125 is closed. That second blocking element 177 translates in the direction of arrow G to the closing position is the result of the fact that, as shown in FIG. 19, the straight side of the sawtooth-like blocking members 181 cannot be carried beyond blocking ribs 175 when second blocking element 177 is rotated in the direction of arrow C, so that when second blocking element 177 is rotated in the direction of arrow C the second blocking element 177 can only translate in the direction of arrow G under the influence of the thread windings 191 and 193 as shown in FIG. 14.

Dispensing container 101 according to FIGS. 13-23 is therefore exceptionally user-friendly for the user. The user can take dispensing container 101 in one hand and, using the fingers of this hand, rotate operating element 117 in the dispensing direction B in order to open reservoir 125 and dispense liquid material 5 therefrom. Using the same fingers the user can subsequently reclose reservoir 125 by rotating operating element 117 in the opposite direction C.

In dispensing container 101 as shown in FIGS. 13-23 the second blocking element 177 is a closing element with which the dispensing opening of reservoir 125 can be closed. Second blocking element 177 is connected to frame 109 for translation along longitudinal axis 133 of frame 109 by means of a translation connection comprising the portion 175*a* of blocking ribs 175 and the sawtooth-like blocking members 181. Second blocking element 177 is also connected by means of a screw connection comprising thread windings 191 and 193 to operating element 117 via clamping body 137. The translation connection is embodied such that in the open position of second blocking element 177 the translation of second blocking element 177 along longitudinal axis 133 of the frame is disassociated from the rotation of the operating element around longitudinal axis 133 of frame 109 in one direction in that the sawtooth-like blocking members 181 can pass over the portion 175*b* of blocking ribs 175 in one direction. In the opposite rotation direction of operating element 117 around longitudinal axis 133 of frame 109 the translation of second blocking element 177 along longitudinal axis 133 of frame 109 is associated with the rotation of operating element 117 around longitudinal axis 133 of frame 109 in that sawtooth-like blocking members 181 cannot then pass over blocking ribs 175. In combination with the sawtooth-like blocking members 181 the two portions 175*a* and 175*b* of blocking ribs 175 here form a coupling construction.

FIGS. 24-29 show the steps with which foldable wall 27 of dispensing containers 1 of FIGS. 1-6 can be attached at the first end 29 thereof to operating element 17 during forming of reservoir 25.

Figure 24:
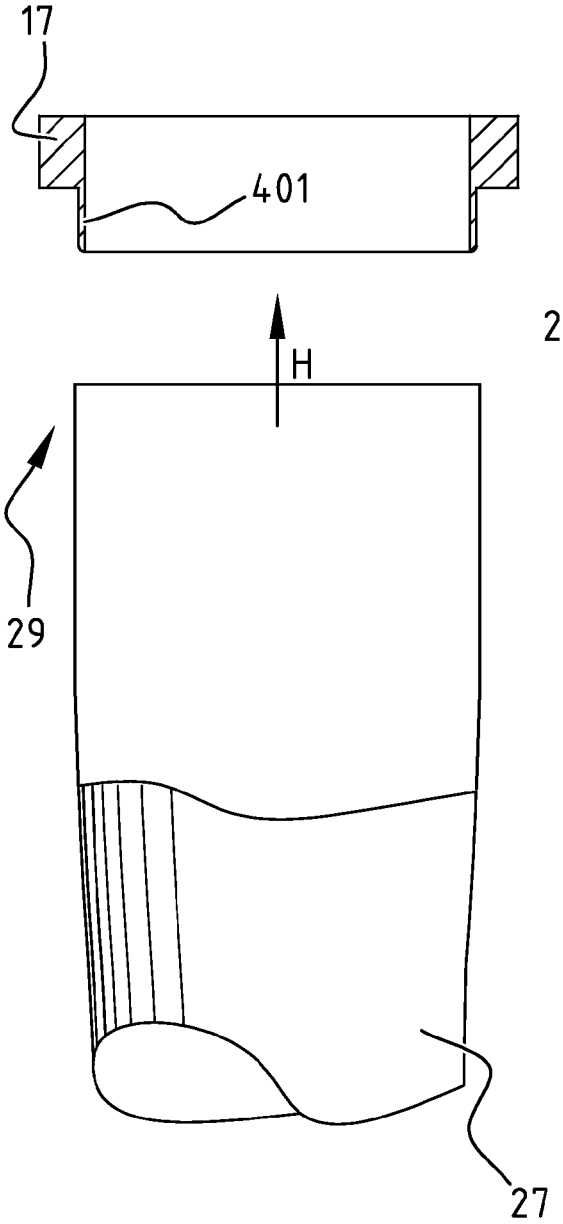
FIGS. 24-29 show longitudinal sectional views of steps during manufacture of the dispensing container of FIG. 1.
Figure 25:
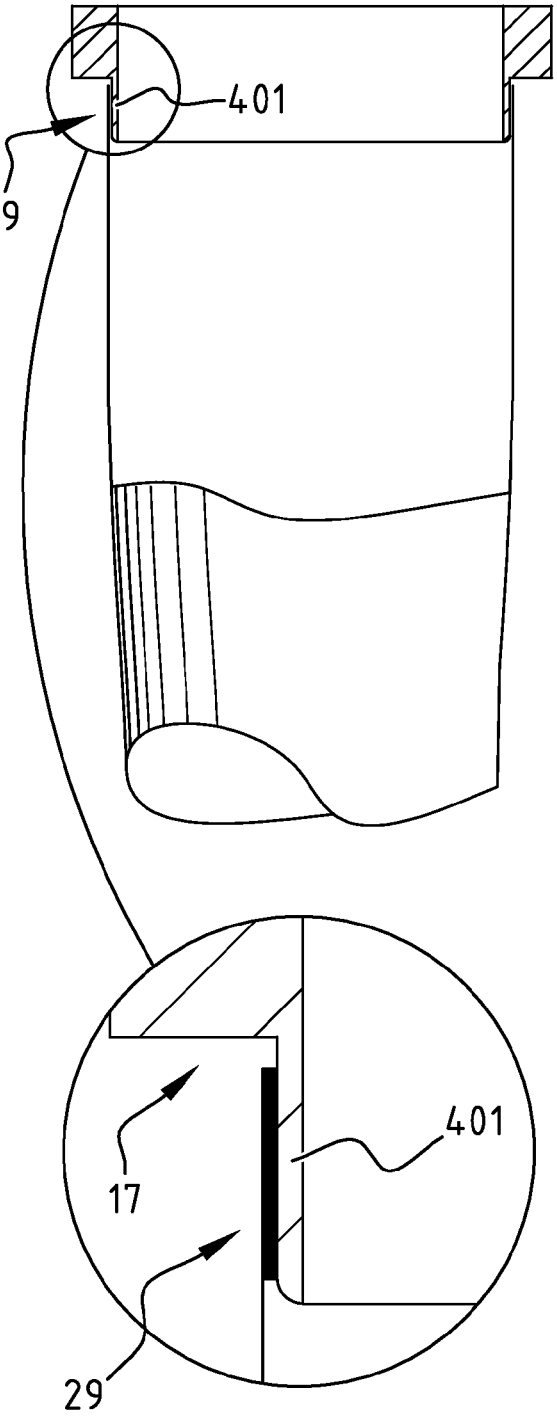

FIGS. 24 and 25 show that in a first step foldable wall 27 is pushed in the direction of arrow H over a flange 401 of operating element 17 and is sealed fixedly thereto. Alternatively, a film from a film roll is pushed against the flange of the operating element and rotated round the flange so that a tube is created, sealed to the operating element and sealed to form a bag enclosing a space.

Figures 26, 27:
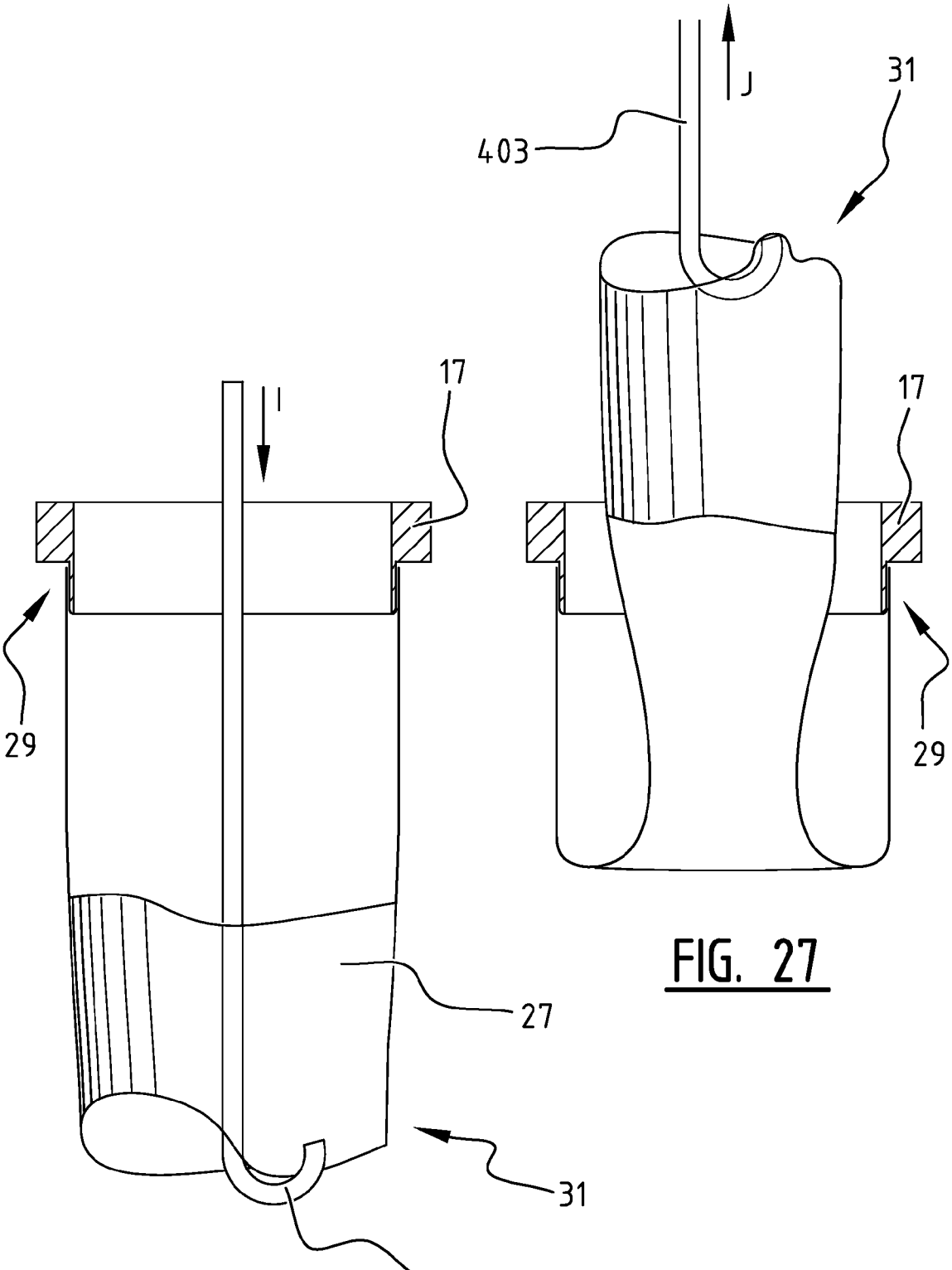

FIGS. 26 and 27 show that, by means of a hook 403 carried first in the direction of arrow I through the annular operating element 17, the second end 31 of foldable wall 27 is subsequently pulled in the direction of arrow J through the annular operating element 17.

Figure 28:
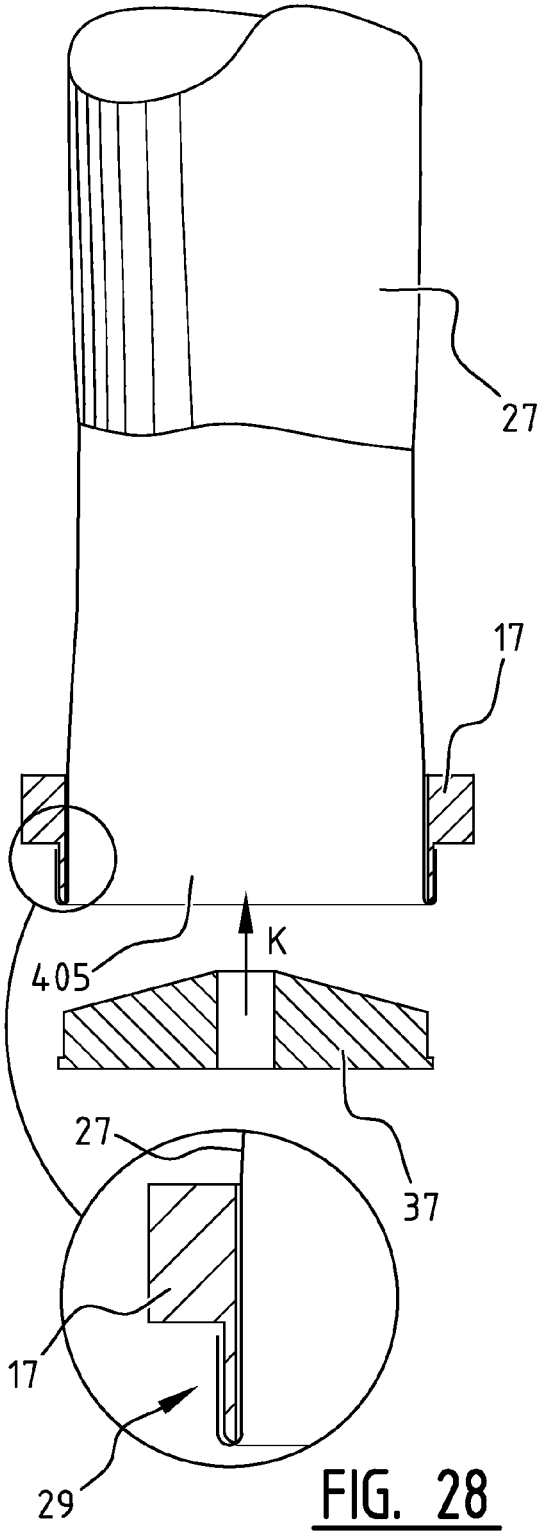
Figure 29:
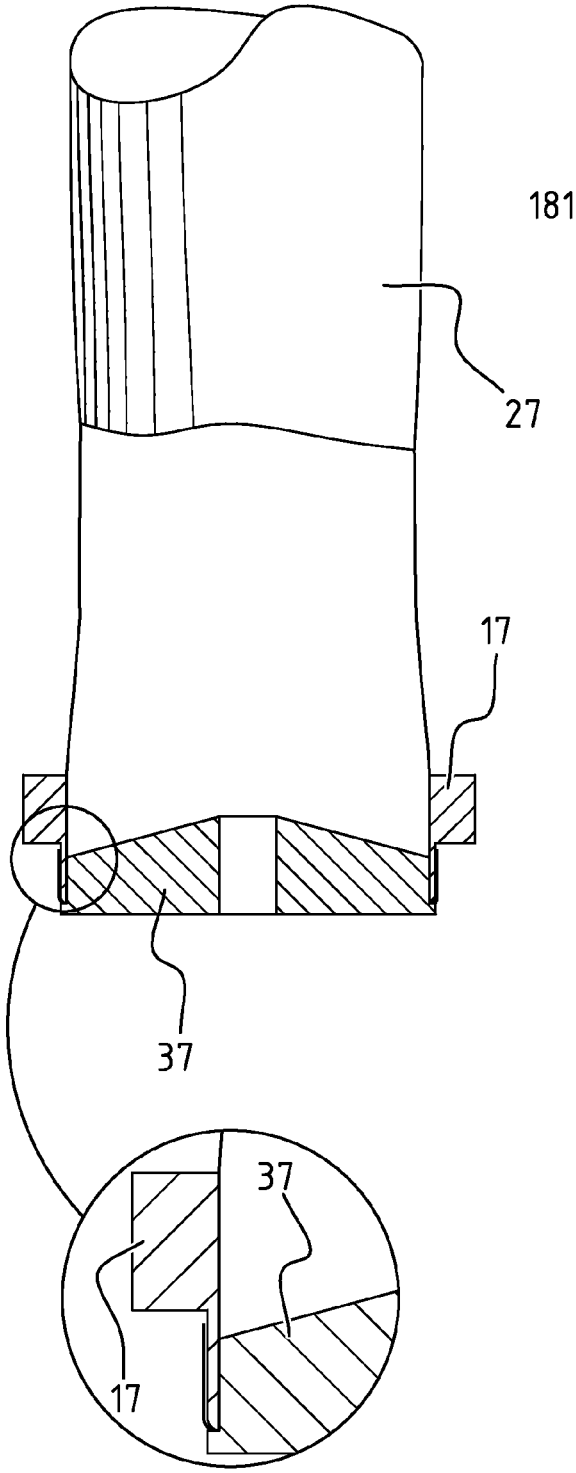

FIGS. 28 and 29 show that clamping body 137 is then placed in the direction of arrow K into the space 405 enclosed by the inner periphery of the annular operating element 17 so that the foldable wall 27 is clamped at the first end 29 thereof between the inner periphery of operating element 17 and the outer periphery of clamping body 37.

Foldable wall 27 is subsequently sealed at the second end 31 thereof, for instance in the form as shown in FIG. 9B. The whole is then turned over, the space enclosed by foldable wall 27 is filled with liquid material 5 and guide element 41 is attached to the second end 31 of foldable wall 27. Alternatively, guide element 41 is attached to the second end 31 of foldable wall 27 before filling of the reservoir.

The thus manufactured filled reservoir 25 is then positioned in the frame which has for instance been formed from the blank as shown in FIG. 7. Second end 31 of foldable wall 27 is here connected non-rotatably to frame 9 by means of guide element 41, in particular by clamping the guide element 41 between walls 15 of the frame, and first end 29 of foldable wall 27 is connected rotatably to frame 9 by means of operating element 17, in particular by inserting a part of operating element 17 into the space enclosed by walls 15 of frame 9 and having a portion of operating element 17 protrude from the holes arranged in walls 15. Alternatively, the operating element is arranged against the edge of the frame at the first end thereof element by means of a connecting element.

This manufacture of a reservoir and subsequent placing of the reservoir in the frame is an important aspect of the method according to the invention.

Dispensing container 101 of FIGS. 13-23 can be manufactured in similar manner.

FIGS. 30-36 show an alternative embodiment of the dispensing container 101 of FIGS. 14-23.

FIGS. 30-33 show a dispensing container 201 which has an elongate frame 209 with a first end 211 and a second end 213. Elongate frame 209 comprises a number of walls 215. The periphery of walls 215 has a polygonal, in particular square cross-section. As in the case of dispensing container 201 of FIGS. 14-23, the cross-sectional dimensions of dispensing container 201 are such that a hand of the user can grip round dispensing container 201. FIGS. 30-33 show that dispensing container 201 is provided close to the first end 211 of frame 209 with an operating element 217 with a circular outer periphery 219. Shown in FIGS. 30-33 is that holes 221 are arranged in walls 215 of frame 209 close to first end 211 thereof. The cross-sectional dimensions of the inner periphery of walls 215 of frame 209, of outer periphery 219 of operating element 217 and of the holes 221 in walls 215 are such that a part of operating element 217 can be positioned in the space enclosed by walls 215 such that the centre 223 of operating element 217 is positioned in the space enclosed by walls 215 and the outer periphery 219 of operating element 217 protrudes from holes 221 at the position of holes 221. Just as in the case of dispensing container 101 as shown in FIGS. 14-23, the portion of operating element 217 protruding from holes 221 can be operated by the user using the fingers of the hand.

Operating element 217 is part of a reservoir 225. Reservoir 225 also has a foldable wall 227 with a first end 229 and a second end 231.

Figure 30:
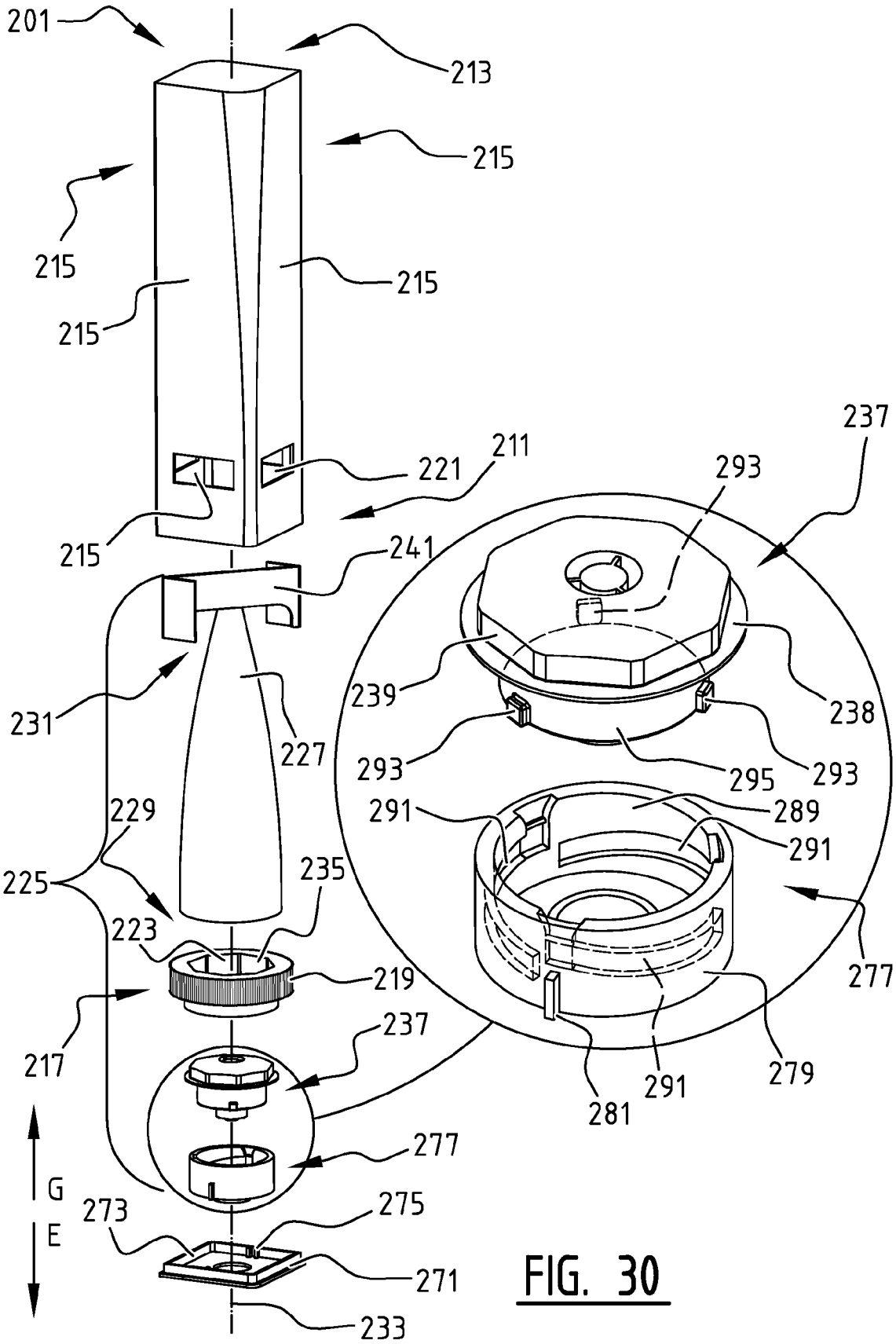
FIG. 30 is a perspective view with exploded parts of an alternative embodiment of the dispensing container of FIGS. 13-23.

Foldable wall 227 is connected at the first end 229 thereof to frame 209 close to the first end of frame 211 for rotation around a longitudinal axis 233 of frame 29 by means of operating element 217. As shown in FIG. 30, operating element 217 is annular and has an inner periphery 235. Reservoir 225 also has a clamping body 237 with an outer periphery 239. Inner periphery 235 of operating element 217 and outer periphery 239 of clamping body 237 are embodied, both being polygonal and having dimensions, such that foldable wall 227 can be clamped at first end 229 thereof between inner periphery 235 of operating element 217 and outer periphery 219 of clamping body 237. A positioning edge 238 protruding outward in radial direction relative to longitudinal axis 233 of frame 209 is arranged on the clamping body. This positioning edge 238 prevents clamping body 237 being placed too far into operating element 217 during assembly, and further contributes toward clamping of the foldable wall between operating element 217 and clamping body 237.

Foldable wall 227 is connected non-rotatably at second end 231 thereof to frame 209 by means of a guide element 241 displaceable along frame 209 in the direction A of first end 229 of foldable wall 227. In the shown embodiment guide element 241 has a Z-shape in top view. Guide element 241 also has relatively high side walls and supports particularly well against two of the walls 215, so avoiding loss of alignment of guide element 241.

The operating principle of dispensing container 201 is the same as the operating principle of dispensing container 1 as shown in FIGS. 4-6. Frame 209 can also be formed from a blank as shown in FIG. 7. Guide elements 41 of FIGS. 1-6 and 8-10 are an alternative to the guide element 241 as applied in FIG. 30.

Just as dispensing container 101 of FIGS. 14-23, dispensing container 201 is provided with a rotation blocking mechanism wherein, just as in the case of dispensing container 101 of FIGS. 14-23, it is not only possible to dispense by means of rotating operating element 217 relative to frame 215 but it is also possible to open or close the dispensing opening 207. Dispensing container 201 is provided for this purpose with an alternative rotation blocking mechanism.

Dispensing container 201 as shown in FIGS. 30-33 is provided with a first blocking element 271 arranged on frame 209 and having an inner periphery 273 which encloses a space. Groove-like guides are formed on inner periphery 273 by means of a number of inward protruding blocking ribs 275. Dispensing container 201 is also provided with a second blocking element 277 having on an outer periphery 279 thereof a number of outward protruding blocking ribs 281 which can be placed into engagement with the groove-like guides of first blocking element 271 so that the second blocking element is arranged in the space enclosed by first blocking element 271 such that a rotation of first blocking element 271 relative to second blocking element 277 around longitudinal axis 233 of frame 209 is blocked, and a translation of first blocking element 271 relative to second blocking element 277 along longitudinal axis 233 of frame 209 in the direction of arrows E and G is free.

Second blocking element 277 is arranged on reservoir 225 by means of a screw connection. The screw connection is embodied by means of a multi-start screw thread wherein each of the screw thread windings is a guide groove 291 arranged on inner periphery 289 of second blocking element 277. A guide element 293 arranged on an outer periphery 295 of clamping body 237 protrudes in each case in guide grooves 291. The screw connection is embodied such that, by means of a rotation of reservoir 225 around longitudinal axis 233 of frame 209 relative to second blocking element 277 by means of operating element 217, second blocking element 277 can be displaced relative to reservoir 225 along longitudinal axis 233 of frame 209 between a closing position and an open position.

Figures 31, 32, 33:
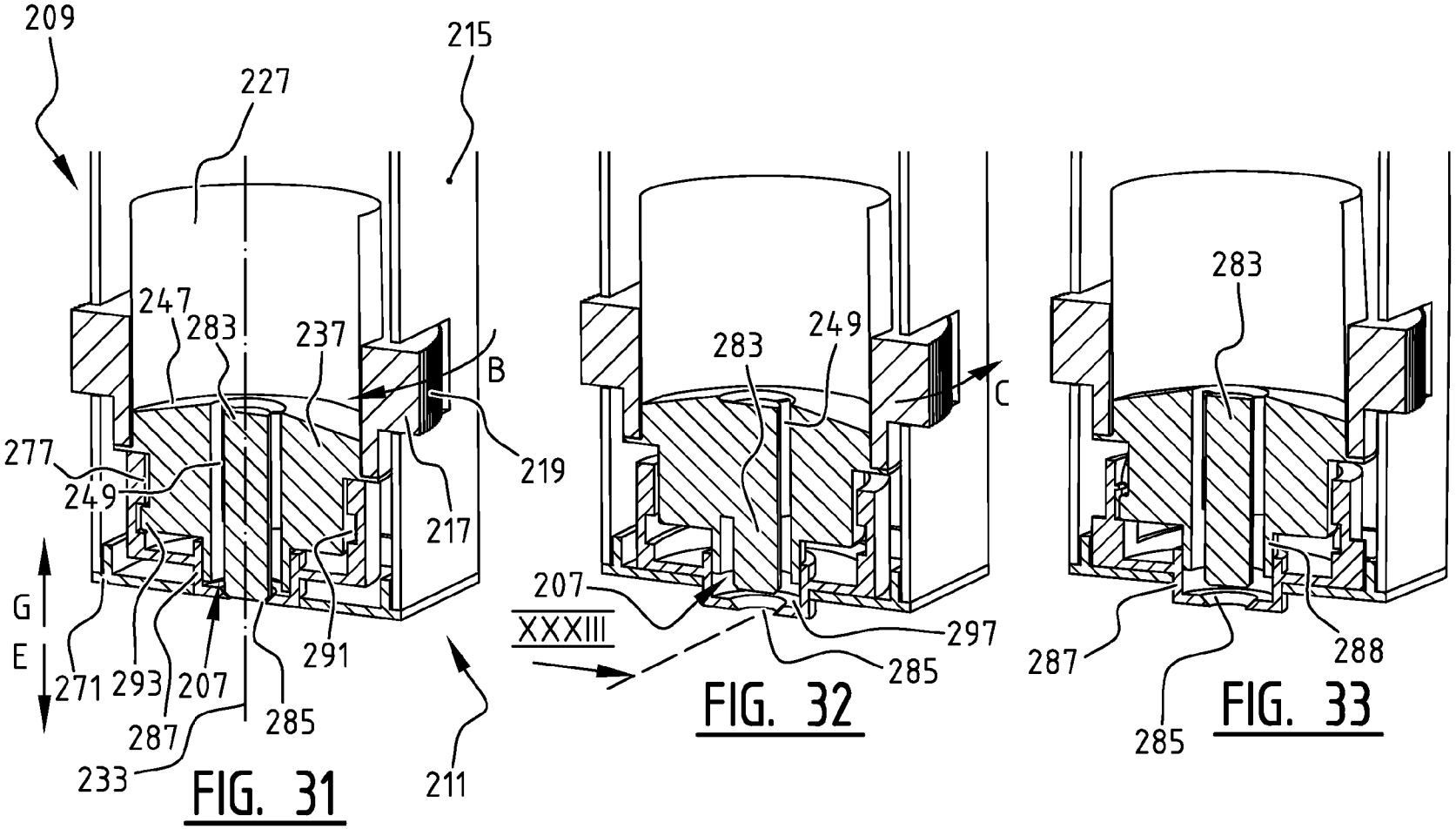
FIGS. 31-33 show a perspective view in longitudinal section of a part of the dispensing container of FIG. 30 in different situations during use thereof.

FIG. 31 shows second blocking element 277 in the closing position, wherein second blocking element 277 closes the dispensing opening 207 of reservoir 225. Second blocking element 277 is hereby a closing element.

Shown is that, just as in the case of dispensing container 101 as shown in FIG. 15, foldable wall 227 is clamped at the first end 229 thereof between the inner periphery of operating element 217 and the outer periphery of clamping body 237. Also shown is that, just as in the case of dispensing container 101 as shown in FIG. 15, clamping body 237 comprises a displacing body 245 with a number of, in this embodiment one, displacement surfaces 247 running obliquely from first end 229 of foldable wall 227 in the direction of second end 231 of foldable wall 227. As shown in FIG. 31, displacement surface 247 forms at the end remote from foldable wall 227 an opening of a dispensing channel 249 to dispensing opening 207 situated close to first end 211 of frame 209.

A core element 283 is arranged in dispensing channel 249 and dispensing opening 207 such that between the outer periphery of the core element and the inner periphery of dispensing opening 207 and the inner periphery of dispensing channel 249 there is a space which communicates with the inner space enclosed by foldable wall 227 of the reservoir.

Second blocking element 277 has an opening 285 and a sliding wall 287 which encloses opening 285 and extends along the wall 288 which encloses dispensing opening 207. The inner periphery of opening 285 and the outer periphery of core element 283 are embodied such that, in the shown closing position of second blocking element 277, they are in closing contact with each other so that reservoir 225 is closed.

By rotating the first end 229 of foldable wall 227 around the longitudinal axis 233 of frame 209 by means of operating element 117 in dispensing direction B from the situation shown in FIG. 31 with the second blocking element in the closing position, guide elements 193 are guided through guide grooves 193 into which they protrude so that second blocking element 277 translates in the direction of arrow E from the closing position to the open position.

Because in the open position as shown in FIGS. 32 and 33 there is a space 297 between the inner periphery of opening 285 of second blocking element 277 and the outer periphery of core element 283, this space 297 communicating with the inner space enclosed by foldable wall 227 of the reservoir, dispensing opening 207 is clear of second blocking element 277 in the open position so that liquid material in the space enclosed by foldable wall 227 can be carried out of reservoir 225.

Figure 34:
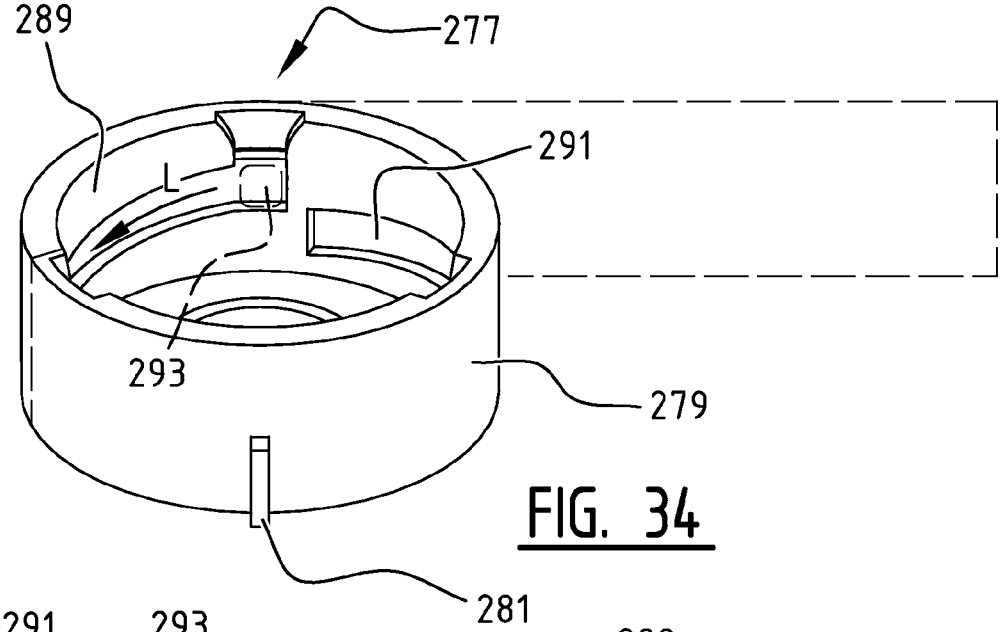
FIG. 34 is a perspective view of a separate component of the dispensing container of FIG. 30.
Figure 35:
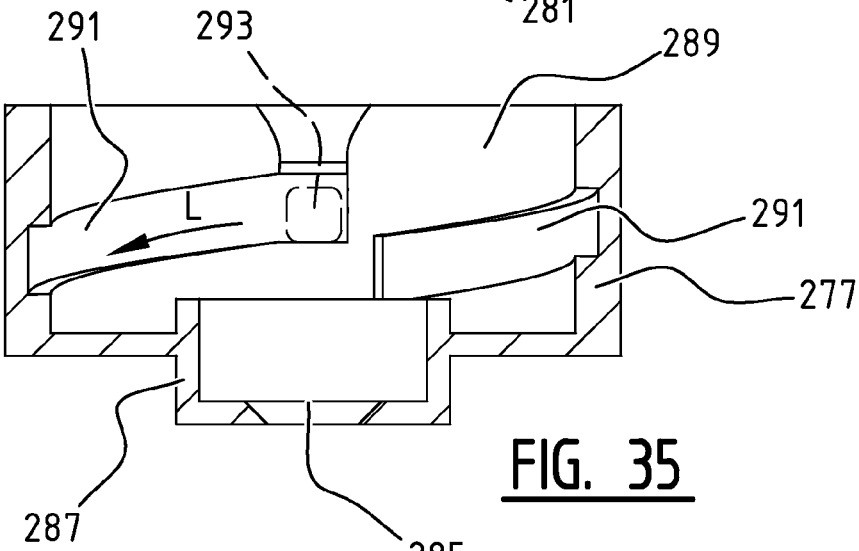
FIG. 35 is a side view in longitudinal section of the component of FIG. 34.
Figure 36:
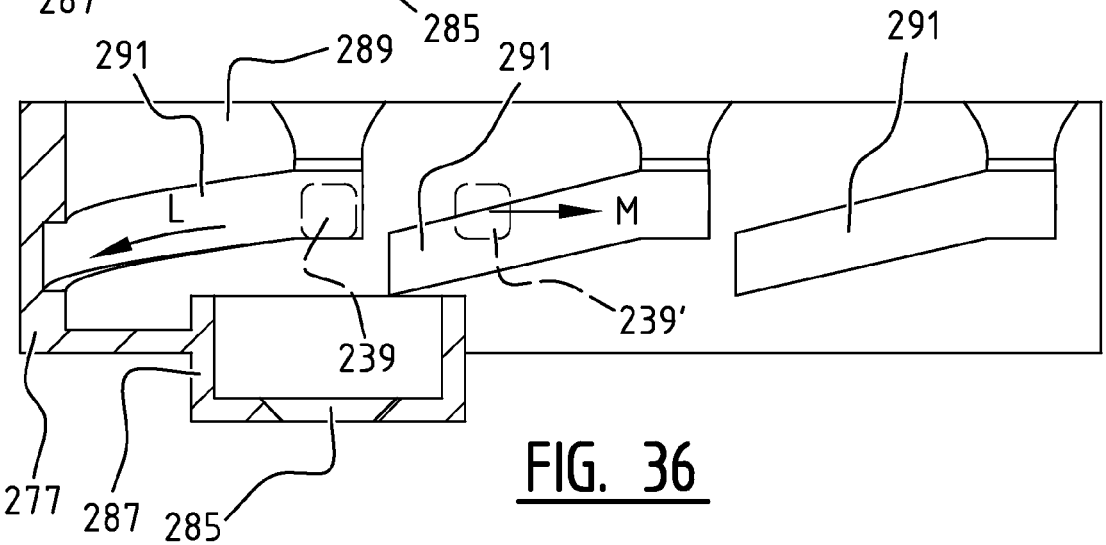
FIG. 36 shows the side view of FIG. 35, schematically with a blank of a part thereof.

FIGS. 34-36 show second blocking element 277 in more detail, wherein FIG. 36 shows a blank of the inner periphery 289 of the second blocking element having therein the guide grooves 291 of the multi-start screw thread.

Shown schematically in FIGS. 34-36 is the position of one of the guide elements 293 which are arranged on the outer periphery of clamping body 237 of reservoir 225 when second blocking element 277 is in the open position. As shown in FIGS. 32 and 33, a further translation of second blocking element 277 from the open position along longitudinal axis 233 of frame 209 in the direction of the closing position is blocked, since in the open position second blocking element 277 lies against first blocking element 271.

By rotating first end 229 of foldable wall 227, and thereby the reservoir with clamping body 237, round longitudinal axis 233 of frame 209 by means of operating element 217 from the open position of second blocking element 277 in the direction C opposite to dispensing direction B, guide elements 293 are guided from the position shown in FIGS. 34-36 in the direction of arrow L through guide grooves 291 so that second blocking element 277 is translated from the open position in the direction of arrow G along longitudinal axis 233 of frame 209 to the closing position as shown in FIG. 31. The embodiment of the portion of guide grooves 291 and the portion of guide elements 293 which come into contact with each other when guide elements 293 are guided through guide grooves 291 is such here as to avoid guide elements 293 being pressed out of guide grooves 291.

By however rotating first end 229 of foldable wall 227, and thereby the reservoir with clamping body 237, round longitudinal axis 233 of frame 209 in the dispensing direction B by means of operating element 217 from the open position of second blocking element 277, guide elements 293 are pressed from the position shown in FIGS. 34-36 in the direction of arrow M out of the guide groove 291 into which they protrude and in the direction of the following guide groove 291, so that guide elements 293 drop into the following guide groove 293. The displacement of a guide element 293 from a first guide groove 291 to a following guide groove 291 is possible with a suitable choice of material, wall thickness of clamping body 237 and second blocking element 277, and depth (variation) and edge form of the guide grooves, so that a temporary deformation of one of the two is possible during the displacement. The portion of guide groove 291 and the portion of guide element 293 which come into contact with each other when guide element 293 is pressed out of the guide groove, can be embodied, for instance by means of a chamfering, such that a simple displacement of the guide elements between successive guide grooves 291 is enhanced. Guide element 293 can take the form as shown in FIGS. 30-36, but can also be more elongate and thereby extend along a larger part of a guide groove into which it protrudes.

Because rotation of first end 229 of foldable wall 227 around longitudinal axis 233 of frame 209 in dispensing direction B by means of operating element 217 is possible in the open position as a result of the displacement of guide elements 293 between successive guide grooves, dispensing of a quantity of liquid material from the space enclosed by foldable wall 227 is possible in the open position. By rotating first end 229 of foldable wall 227 around longitudinal axis 233 of frame 209 by means of operating element 217 in the opposite direction C after dispensing, second blocking element 277 can as described above be returned to the closing position in which the dispensing opening is closed.

In dispensing container 201 as shown in FIGS. 30-36 the second blocking element 277 is a closing element with which the dispensing opening of reservoir 225 can be closed. Second blocking element 277 can be connected to frame 209 for translation along longitudinal axis 233 of frame 209 by means of a translation connection comprising blocking ribs 275 and blocking ribs 281. Second blocking element 277 is also connected to operating element 217 via clamping body 237 by means of a screw connection comprising guide grooves 291 and guide elements 293. The screw connection is embodied such that in the open position of second blocking element 277 the translation of second blocking element 277 along longitudinal axis 233 of the frame is disassociated from the rotation of the operating element around longitudinal axis 233 of frame 209 in one direction, since guide elements 293 are pressed out of guide grooves 291 in the direction of a following guide groove 293. In the opposite rotation direction of operating element 217 around longitudinal axis 233 of frame 209 the translation of second blocking element 277 along longitudinal axis 233 of frame 209 is associated with the rotation of operating element 217 around longitudinal axis 233 of frame 209 since the guide elements 293 are then guided through guide grooves 291. In combination the thus embodied guide elements 293 and guide grooves 293 here form a coupling construction.

Guide grooves 293 as shown in FIGS. 34-36 could be mutually connected by means of additional grooves guiding the guide elements 293 from a guide groove 291 to a following guide groove 291. Ribs must then be arranged here in the additional grooves to guide the guide elements 293 in guide grooves 291 during displacement of guide elements 293 in the opposite direction.

Figure 37:
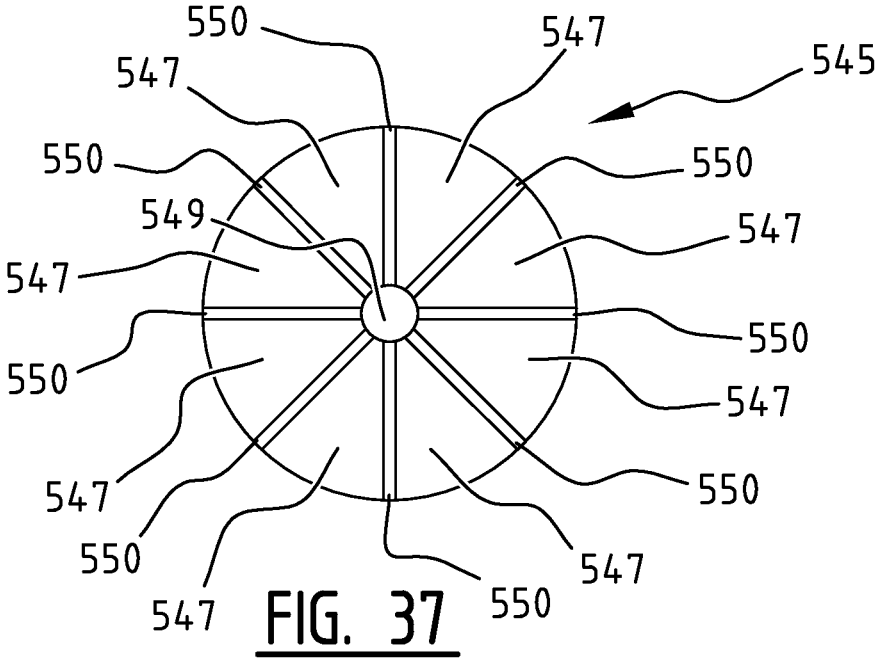
FIG. 37 is a top view of an embodiment of a displacing element of a dispensing container according to the invention.
Figure 38A:
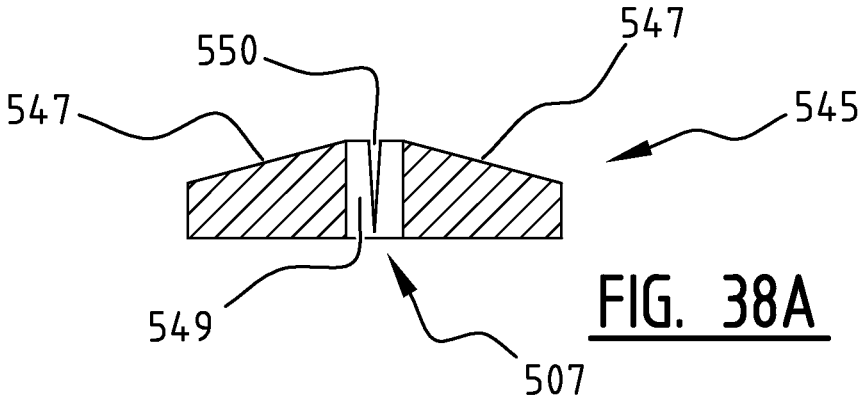
FIG. 38 is a side view in longitudinal section of the displacing element of FIG. 37.
Figure 38B:
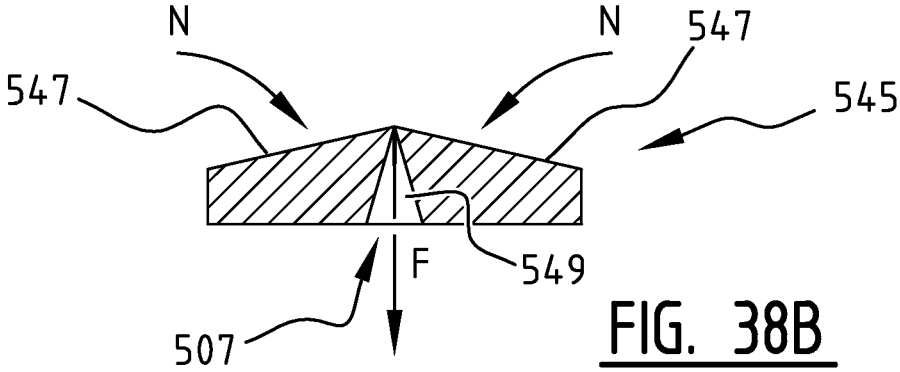

FIGS. 37 and 38A show an alternative embodiment of the displacing element 145 and 245 as shown in the foregoing figures. Displacing element 545 in particular is not provided with one continuous displacement surface but with a plurality of displacement surfaces 547 separated from each other by means of obliquely running indentations 550 in displacing element 545. These indentations 550 make it possible, when the reservoir is almost empty, for dispensing channel 549 to be squeezed together from the opening formed by displacement surfaces 547 in the direction of dispensing opening 507 when the foldable wall as shown in FIG. 6 is pushed in the direction of arrows N against displacement surfaces 547. This creates the situation as shown in FIG. 38B, wherein liquid material present in dispensing channel 549 is forced out of dispensing opening 507 in the direction of arrow F.

FIGS. 13-36 show different embodiments of a closing mechanism, wherein different components can in each case be translated or rotated relative to each other. It is generally the case with such mechanisms that, instead of a movement from the one component in the direction of a second component, a realization is also possible wherein the second component moves in the direction of the first component.

Shown in FIGS. 13-36 are embodiments wherein a closing element is embodied by means of a second blocking element connected to the frame via a first blocking element and connected to the operating element via a clamping body. Alternatively, it is for instance possible to provide, instead of the clamping body, an alternative body to which the first end of the foldable wall is sealed, which alternative body is connected by means of a screw connection to the operating element and by means of a translation connection to the first blocking element, and on which alternative body a core element is arranged which can close the opening in the first blocking element. In that case the alternative body is a closing element which can be displaced along the longitudinal axis of the frame between an open position and a closing position, and the second blocking element can be omitted.

In a further alternative embodiment relative to the shown embodiments the operating element can for instance be operated via an additional operating element in a screw wheel construction, wherein the operating element serves as screw wheel and the additional operating element serves as screw.

The invention claimed is:

1. A dispensing container, the dispensing container comprising:

an elongate frame with a first end and a second end; and an elongate reservoir extending between the first end and the second end of the frame;

wherein the reservoir comprises:

a foldable wall which is connected at a first end thereof to the frame close to the first end of the frame for rotation around a longitudinal axis of the frame by means of an operating element, and which is connected non-rotatably to the frame at a second end thereof;

a dispensing opening close to the first end of the frame; and a closing element displaceable between a closing position and an open position relative to the dispensing opening, wherein in the closing position the closing element closes the dispensing opening of the reservoir, and in the open position the dispensing opening is clear of the closing element;

wherein the closing element is connected to the operating element and the frame via a movement-transmitting connecting construction;

wherein the movement-transmitting connecting construction is adapted such that in the closing position of the closing element a displacement of the closing element from the closing position to the open position is associated with a rotation of the operating element around the longitudinal axis of the frame in the dispensing direction;

in the open position of the closing element a displacement of the closing element from the open position to the closing position is associated with a rotation of the operating element around the longitudinal axis of the frame in the direction opposite to the dispensing direction;

in the open position of the closing element a displacement of the closing element from the open position to the closing position is disassociated from a rotation of the operating element around the longitudinal axis of the frame in the dispensing direction.

2. The dispensing container as claimed in claim 1, wherein the reservoir comprises a constriction close to the second end of the foldable wall.

3. The dispensing container as claimed in claim 1, wherein the reservoir comprises close to the first end of the foldable wall a displacing body with a number of displacement surfaces running obliquely from the first end of the foldable wall in the direction of the second end of the foldable wall, which displacement surfaces form at the end remote from the foldable wall an opening of a dispensing channel to the dispensing opening.

4. The dispensing container as claimed in claim 1, wherein the second end of the foldable wall is connected to the frame by means of a guide element displaceable along the frame in the direction of the first end of the foldable wall.

5. The dispensing container as claimed in claim 1, wherein the frame can be reduced in length between the first end of the foldable wall and the second end of the foldable wall, wherein the frame between the first end of the foldable wall and the second end of the foldable wall is preferably at least one from the group of foldable together and slidable together.

6. The dispensing container as claimed claim 1, wherein the frame comprises a number of walls which enclose the reservoir in the longitudinal direction thereof.

7. The dispensing container as claimed in claim 6, wherein the cross-sectional periphery of the walls of the frame is one from the group of round and polygonal.

8. The dispensing container as claimed in claim 7, wherein the cross-sectional periphery of the walls of the frame is square.

9. The dispensing container as claimed in claim 6, wherein the operating element has a circular outer periphery;

the inner periphery of the walls of the frame has a cross-sectional form varying from a circle; and a number of holes are arranged in the walls of the frame close to the first end of the frame;

wherein the dimensions of the inner periphery of the walls of the frame, of the outer periphery of the operating element and of the holes in the walls are such that a part of the operating element can be positioned in the space enclosed by the walls such that the center of the operating element is positioned in the space enclosed by the walls and the outer periphery of the operating element at the position of the holes protrudes from the holes.

10. The dispensing container as claimed in claim 1, wherein the operating element is annular and has an inner periphery; and the reservoir also comprises a clamping body with an outer periphery;

wherein the inner periphery of the operating element and the outer periphery of the clamping body are embodied such that the foldable wall can be clamped at the first end thereof between the inner periphery of the operating element and the outer periphery of a clamping body;

the foldable wall is clamped at the first end thereof between the inner periphery of the operating element and the outer periphery of a clamping body.

11. The dispensing container as claimed in claim 10, wherein the clamping body comprises the displacing body.

12. The dispensing container as claimed in claim 1, also comprising a rotation blocking mechanism which is adapted such that the rotation of the first end of the foldable wall around the longitudinal axis of the frame by means of the operating element is free in a dispensing direction, and the rotation is blocked in the opposite direction.

13. The dispensing container as claimed in claim 12, wherein the rotation blocking mechanism comprises a number of sawtooth-like blocking members arranged on the outer periphery of the operating element, wherein the dimensions of the operating element and of the holes in the walls of the frame through which the operating element protrudes are such that an edge of the holes comes into contact with a sawtooth during rotation of the operating element around the longitudinal axis.

14. The dispensing container as claimed in claim 12, wherein the rotation blocking mechanism comprises:

a first blocking element arranged on the frame and having an inner periphery which encloses a space, and a number of first blocking members protruding inward from the inner periphery thereof;

a second blocking element arranged on the reservoir and co-acting with the first blocking element and having a number of outward protruding blocking members on an outer periphery thereof;

wherein the second blocking element is positioned in the space enclosed by the first blocking element;

the first blocking members are one of blocking ribs and sawtooth-like blocking members and the second blocking members are the other of blocking ribs and sawtooth-like blocking members; and the dimensions of the first blocking element and of the second blocking element are such that one sawtooth-like blocking member at a time comes into contact with a blocking rib when the first end of the foldable wall is rotated around the longitudinal axis of the frame by means of the operating element.

15. The dispensing container as claimed in claim 1, wherein the movement-transmitting connecting construction comprises:

a screw connection with which the closing element is connected to the operating element, the screw connection being adapted such that a rotation of the operating element around the longitudinal axis of the frame relative to the closing element results in a displacement of the closing element along the longitudinal axis of the frame; and a translation connection with which the closing element is connected to the frame, the translation connection being adapted such that a displacement of the closing element along the longitudinal axis of the frame is free and a rotation of the closing element relative to the frame around the longitudinal axis of the frame is blocked; and a coupling construction which is adapted in the open position of the closing element to uncouple at least one of the screw connection and the translation connection from the closing element such that a rotation of the closing element around the longitudinal axis of the frame is uncoupled from the relevant connection in one direction and is coupled in the opposite direction.

16. The dispensing container as claimed in claim 1, wherein the second blocking element is the closing element; and in the closing position of the closing element, when the first end of the foldable wall is rotated around the longitudinal axis of the frame by means of the operating element, the sawtooth-like blocking members come into contact with a portion of the blocking ribs which is embodied such that a rotation of the second blocking element relative to the first blocking element is blocked in both rotation directions and that the second blocking element can be translated along the longitudinal axis so that, when the first end of the foldable wall is rotated around the longitudinal axis of the frame by means of the operating element in the dispensing direction, the second blocking element can be displaced from the closing position to the open position; and in the open position of the closing element, when the first end of the foldable wall is rotated around the longitudinal axis of the frame by means of the operating element, the sawtooth-like blocking members come into contact with a portion of the blocking ribs which is embodied such that a rotation of the second blocking element relative to the first blocking element is free in one direction and blocked in the opposite direction so that, when the first end of the foldable wall is rotated around the longitudinal axis of the frame by means of the operating element in the dispensing direction, the rotation of the second blocking element relative to the first blocking element is free.

17. The dispensing container as claimed in claim 1, wherein the rotation blocking mechanism comprises:

a first blocking element arranged on the frame and having an inner periphery which encloses a space;

a second blocking element arranged on the reservoir and co-acting with the first blocking element;

wherein the second blocking element is arranged in the space enclosed by the first blocking element such that a rotation of the first blocking element relative to the second blocking element around the longitudinal axis of the frame is blocked and a translation of the first blocking element relative to the second blocking element along the longitudinal axis of the frame is free, wherein the second blocking element is the closing element connected by means of a screw connection to the operating element;

wherein the screw connection comprises:

a multi-start screw thread wherein each of the thread windings comprises a guide groove arranged on one of the second blocking element and the reservoir and a number of guide elements which are arranged on the other of the second blocking element and the reservoir and which each protrude into one of the guide grooves; wherein in the closing position the second blocking element closes the dispensing opening of the reservoir and, when the first end of the foldable wall is rotated around the longitudinal axis of the frame by means of the operating element in the dispensing direction, the guide elements are guided through the guide grooves into which they protrude so that the second blocking element can be translated from the closing position to the open position;

in the open position the dispensing opening is clear of the second blocking element and the second blocking element is in contact with the first blocking element such that further translation of the second blocking element away from the closing position is blocked;

and wherein the reservoir and the second blocking element are embodied such that when the first end of the foldable wall is rotated around the longitudinal axis of the frame by means of the operating element in the dispensing direction in the open position of the second blocking element, the guide elements are pressed out of the guide grooves into which they protrude in the direction of a following guide groove; and that when the first end of the foldable wall is rotated around the longitudinal axis of the frame by means of the operating element in opposite direction in the open position of the second blocking element, the guide elements are guided through the guide grooves into which they protrude so that the second blocking element can be translated from the open position to the closing position.

18. The dispensing container as claimed in claim 16, wherein a core element is arranged in the dispensing opening such between the outer periphery of the core element and the inner periphery of the dispensing opening there is a space which communicates with the inner space enclosed by the foldable wall of the reservoir; and the second blocking element comprises an opening and a sliding wall enclosing the opening and extending along the wall enclosing the dispensing opening; wherein the inner periphery of the opening and the outer periphery of the core element are embodied such that in the closing position they are in closing contact with each other and that in the open position there is a space between the inner periphery of the opening and the outer periphery of the core element which communicates with the inner space enclosed by the foldable wall of the reservoir;

the sliding wall and the wall enclosing the dispensing opening are embodied such that they are in closing contact with each other in both the open position and the closing position.

19. A method for forming a dispensing container as claimed in claim 1, comprising the steps of manufacturing an elongate frame with a first end and a second end; and manufacturing an elongate reservoir with a foldable wall provided at a first end thereof with an operating element and a dispensing opening;

connecting the first end of the foldable wall for rotation around a longitudinal axis of the frame by means of the operating element close to the first end of the frame; and connecting the second end of the foldable wall non-rotatably to the frame.

20. A dispensing container as claimed in claim 1, wherein the cross-sectional dimensions of the dispensing container are such that a hand of the user can grip round the dispensing container.

* * * * *